US010836534B2

(12) United States Patent
Guerry et al.

(10) Patent No.: US 10,836,534 B2
(45) Date of Patent: Nov. 17, 2020

(54) DAIRY TRAY SYSTEM

(71) Applicant: Rehrig Pacific Company, Los Angeles, CA (US)

(72) Inventors: Brian Robert Guerry, Costa Mesa, CA (US); Sydney Marie Ogawa-Garcia, Riverside, CA (US); Suzanne Whitfield Clark, Santa Monica, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 15/586,995

(22) Filed: May 4, 2017

(65) Prior Publication Data

US 2017/0341811 A1 Nov. 30, 2017

Related U.S. Application Data

(60) Provisional application No. 62/331,957, filed on May 4, 2016.

(51) Int. Cl.

| | |
|---|---|
| ***B65D 21/00*** | (2006.01) |
| ***B65D 21/02*** | (2006.01) |
| ***B65D 71/70*** | (2006.01) |
| ***B65D 1/34*** | (2006.01) |
| ***B65D 21/04*** | (2006.01) |
| ***B65D 85/80*** | (2006.01) |

(52) U.S. Cl.
CPC ..... *B65D 21/0233* (2013.01); *B65D 1/34* (2013.01); *B65D 21/048* (2013.01); *B65D 71/70* (2013.01); *B65D 85/80* (2013.01)

(58) Field of Classification Search
CPC .... B65D 21/0233; B65D 21/048; B65D 1/43; B65D 1/243; B65D 71/79; B65D 85/80; B65D 2501/24687; B65D 2501/24267; B65D 2501/24592; B65D 2501/24694
USPC ..... 206/427, 503, 505, 203, 509, 515, 518, 206/519; 220/507, 509, 516, 519, 23.83, 220/515, 606
See application file for complete search history.

(56) References Cited

U.S. PATENT DOCUMENTS

| | | | |
|---|---|---|---|
| 2,626,079 | A | 1/1953 | Keller |
| 2,970,715 | A | 2/1961 | Kappel et al. |
| 3,055,531 | A | 9/1962 | De Chelbor |

(Continued)

FOREIGN PATENT DOCUMENTS

| | | |
|---|---|---|
| EP | 2815991 | 12/2014 |
| WO | 9410053 | 5/1994 |

OTHER PUBLICATIONS

Non-Final Office Action for U.S. Appl. No. 14/723,946 dated Oct. 20, 2016.

(Continued)

*Primary Examiner* — Fenn C Mathew
*Assistant Examiner* — Elizabeth J Volz
(74) *Attorney, Agent, or Firm* — Carlson, Gaskey & Olds, P.C.

(57) ABSTRACT

A tray includes a base having an upper support surface and a central portion extending downward to define a lowermost surface of the tray. The base includes a peripheral portion recessed relative to the central portion. A pair of opposed first walls extend along opposed first edges of the base. A pair of opposed second walls extending along opposed second edges of the base.

25 Claims, 35 Drawing Sheets

(56) References Cited

U.S. PATENT DOCUMENTS

| | | | | |
|---|---|---|---|---|
| 3,332,574 | A | 7/1967 | Earp | |
| 3,333,727 | A | 8/1967 | Belcher et al. | |
| 3,349,943 | A | 10/1967 | Box | |
| 3,391,814 | A | 7/1968 | Box | |
| 3,392,869 | A | 7/1968 | Needt | |
| 3,416,694 | A | 12/1968 | Bebb | |
| 3,428,207 | A | 2/1969 | Schoeller | |
| 3,680,735 | A | 8/1972 | Lucas | |
| 3,948,190 | A | 4/1976 | Cook, III et al. | |
| 3,982,654 | A | 9/1976 | Gottsegen | |
| 4,162,738 | A | 7/1979 | Wright | |
| 4,344,530 | A | 8/1982 | deLarosiere | |
| 4,360,231 | A | 11/1982 | Bolin | |
| 4,457,426 | A | 7/1984 | Humphries | |
| 4,471,987 | A | 9/1984 | Erickson | |
| 4,618,059 | A | 10/1986 | Cochram | |
| 4,634,002 | A | 1/1987 | Delonghi | |
| 4,653,651 | A | 3/1987 | Flum | |
| 4,757,910 | A | 7/1988 | Box | |
| 4,846,365 | A | 7/1989 | Steinlein | |
| 4,865,202 | A | 9/1989 | Day | |
| 4,978,002 | A | 12/1990 | Apps et al. | |
| 5,031,761 | A | 7/1991 | de Larosiere | |
| 5,038,961 | A | 8/1991 | Watanabe et al. | |
| 5,060,819 | A | 10/1991 | Apps | |
| 5,071,026 | A | 12/1991 | Apps | |
| 5,184,748 | A | 2/1993 | Apps | |
| 5,263,605 | A | 11/1993 | Caton | |
| 5,360,112 | A | 11/1994 | Beauchamp | |
| 5,377,862 | A | 1/1995 | Oakes et al. | |
| 5,445,273 | A | 8/1995 | Apps | |
| 5,465,843 | A | 11/1995 | Koefelda | |
| 5,660,279 | A | 8/1997 | Apps et al. | |
| 5,823,376 | A | 10/1998 | McGrath | |
| 5,826,712 | A | 10/1998 | Aikio | |
| 5,842,572 | A | 12/1998 | Apps et al. | |
| 5,913,424 | A | 6/1999 | Kelly et al. | |
| 6,047,844 | A | 4/2000 | McGrath | |
| 6,073,793 | A | 6/2000 | Apps et al. | |
| D446,015 | S | 8/2001 | Apps | |
| 6,279,770 | B1 | 8/2001 | Osbakk et al. | |
| 6,325,210 | B1 | 12/2001 | Henry, Jr. | |
| D468,364 | S | 1/2003 | Beadell et al. | |
| D483,946 | S | 12/2003 | Koefelda | |
| D487,634 | S | 3/2004 | Apps et al. | |
| 6,789,828 | B1 | 9/2004 | Borg | |
| 6,892,885 | B2 | 5/2005 | Apps et al. | |
| D507,880 | S | 8/2005 | Hassell et al. | |
| 6,966,442 | B2 | 11/2005 | Hassell et al. | |
| 7,207,458 | B1 | 4/2007 | Koefelda et al. | |
| 7,322,475 | B2 | 1/2008 | Hassell et al. | |
| 7,322,486 | B2 | 1/2008 | Koefelda et al. | |
| 7,448,493 | B2 | 11/2008 | Wong | |
| D615,758 | S | 5/2010 | Lindstrom | |
| 7,743,939 | B2 | 6/2010 | Stahl | |
| 7,950,521 | B2 | 5/2011 | Apps | |
| 8,056,753 | B2 | 11/2011 | Koefelda et al. | |
| 8,522,967 | B2 | 9/2013 | Lindstrom | |
| 9,114,901 | B2 * | 8/2015 | Apps | B65D 1/243 |
| 9,315,291 | B2 | 4/2016 | Kelly et al. | |
| 9,327,890 | B1 | 5/2016 | Connelly | |
| 9,409,688 | B2 | 8/2016 | Kelly et al. | |
| 9,475,602 | B2 | 10/2016 | Apps | |
| 9,809,366 | B2 | 11/2017 | Prince et al. | |
| 2001/0019063 | A1 | 9/2001 | Apps | |
| 2002/0148837 | A1 | 10/2002 | Apps | |
| 2003/0070957 | A1 * | 4/2003 | Apps | B65D 1/243 206/518 |
| 2005/0279651 | A1 | 12/2005 | Perret et al. | |
| 2007/0246392 | A1 | 10/2007 | Stahl | |
| 2011/0284411 | A1 | 11/2011 | Delbrouck et al. | |
| 2012/0317929 | A1 | 12/2012 | Ramberg et al. | |
| 2013/0087477 | A1 | 4/2013 | Kuhn et al. | |
| 2013/0199953 | A1 * | 8/2013 | Lindstrom | B65D 85/00 206/427 |
| 2015/0001114 | A1 | 1/2015 | Kelly et al. | |
| 2015/0183552 | A1 | 7/2015 | Kelly et al. | |
| 2015/0298878 | A1 | 10/2015 | Clark | |
| 2015/0344167 | A1 | 12/2015 | Clark | |
| 2016/0016689 | A1 | 1/2016 | Apps et al. | |
| 2016/0130057 | A1 | 5/2016 | Stahl | |
| 2016/0200480 | A1 | 7/2016 | Clark | |

OTHER PUBLICATIONS

Final Office Action for U.S. Appl. No. 14/723,946 dated Apr. 3, 2017.

Non-Final Office Action for U.S. Appl. No. 14/723,946 dated Mar. 7, 2018.

Final Office Action for U.S. Appl. No. 14/723,946 dated Sep. 21, 2018.

* cited by examiner

DAIRY TRAY SYSTEM

BACKGROUND

Some products, such as dairy products in retail store, are often shipped to the store in containers, such as trays. The loaded trays may be stacked by hand onto a pallet. The loaded pallet is then shipped to the store, where the loaded trays are removed from the pallet by hand. The products may be removed from the trays by hand and loaded onto a shelf in a refrigerator.

SUMMARY

A tray includes a base having an upper support surface and a central portion extending downward to define a lowermost surface of the tray. The base includes a peripheral portion offset upwardly relative to the central portion. Fork tines of a lift may be received under the peripheral portion of the base to lift the tray off the floor. A pair of opposed first walls extend along opposed first edges of the base. A pair of opposed second walls extending along opposed second edges of the base.

The tray may include a plurality of upper column portions along an inner periphery of the first walls and second walls. The tray may also including a plurality of lower column portions between and below the plurality of upper column portions.

The tray may be a first tray in a multiple tray system that further includes a second tray with the same footprint as the first tray. The second tray is also substantially similar to the first tray, but is configured for different size containers. For example, the second tray may have upper column portions that project into the tray further than those of the first tray.

The trays disclosed herein perform similarly to both a pallet and a secondary packaging tray. Therefore, the cross section is significantly increased compared to the beverage crates currently in the market. The rib structure of the base reaches the bottom of the tray and the rib structure of the peripheral portion of the base (the lifting surface or ledge) reaches the base of that feature.

The trays disclosed herein stacked on a pallet can be shopped directly out of in the store. When a tray is empty, it can be set aside, nested, or stored and the next tray with primary packaging below can be shopped. When a tray is behind a cooler door and half shopped, the primary packaging can slide to the front manually because the inside surface is not broken or pocketed.

DETAILED DESCRIPTION OF PREFERRED EMBODIMENTS

Figure 1:
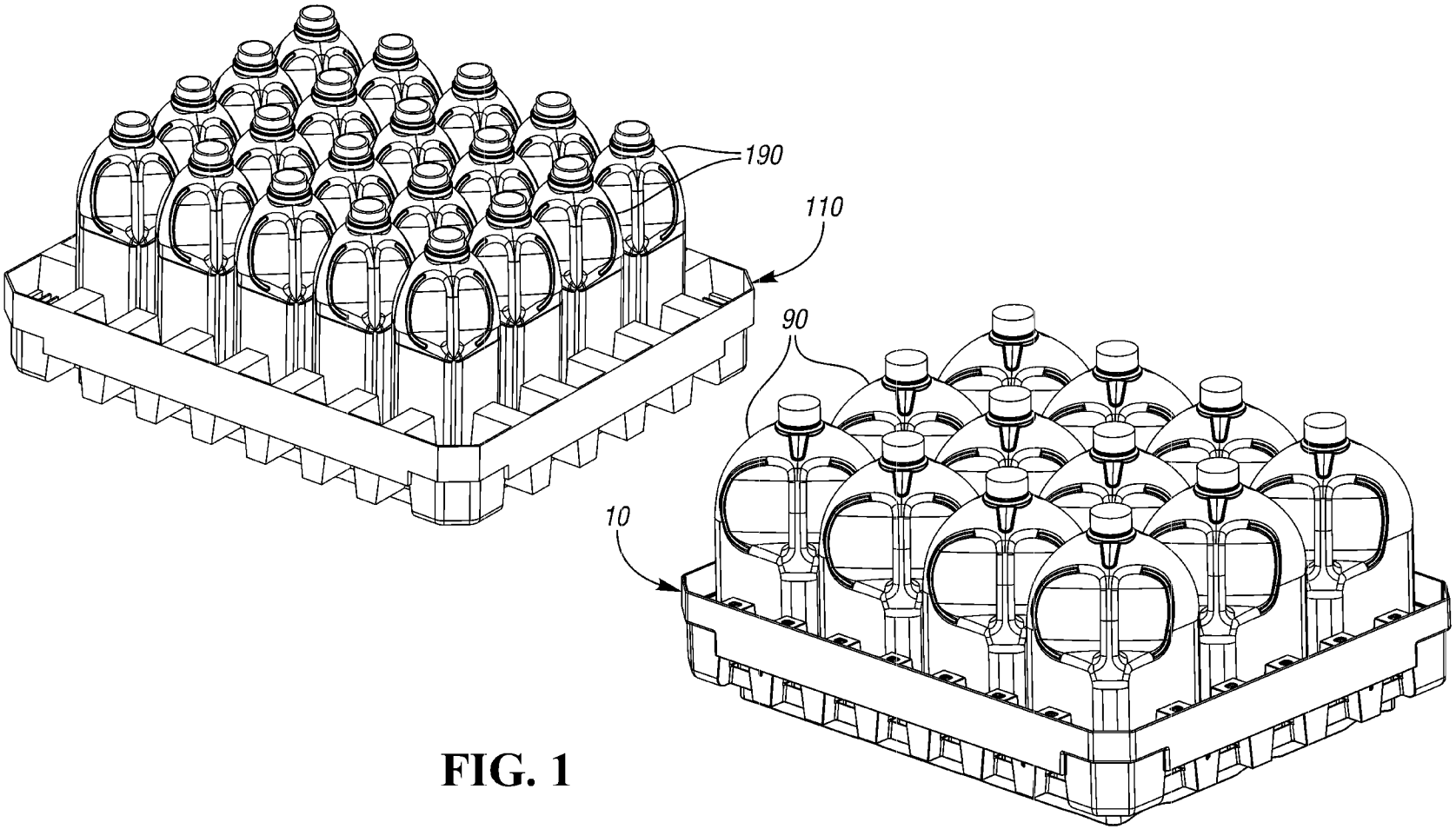
FIG. 1 shows a dairy tray system including a first tray and a second tray.

A dairy tray system according to one embodiment is shown in FIG. 1. The dairy tray system includes a plurality of first trays 10 (one shown) for holding large containers, such as one-gallon milk jugs 90 and a plurality of second trays 110 (one shown) for holding smaller containers, such as half-gallon milk jugs 190. The first tray 10 holds the one-gallon jugs 90 in a 4×3 array while the second tray 110 holds the half-gallon milk jugs 190 in a 4×5 array; however, both trays 10, 110 have the same footprint (width and length) and height. In this example, the internal dimensions vary in order to accommodate the different size containers 90, 190.

Figure 2:
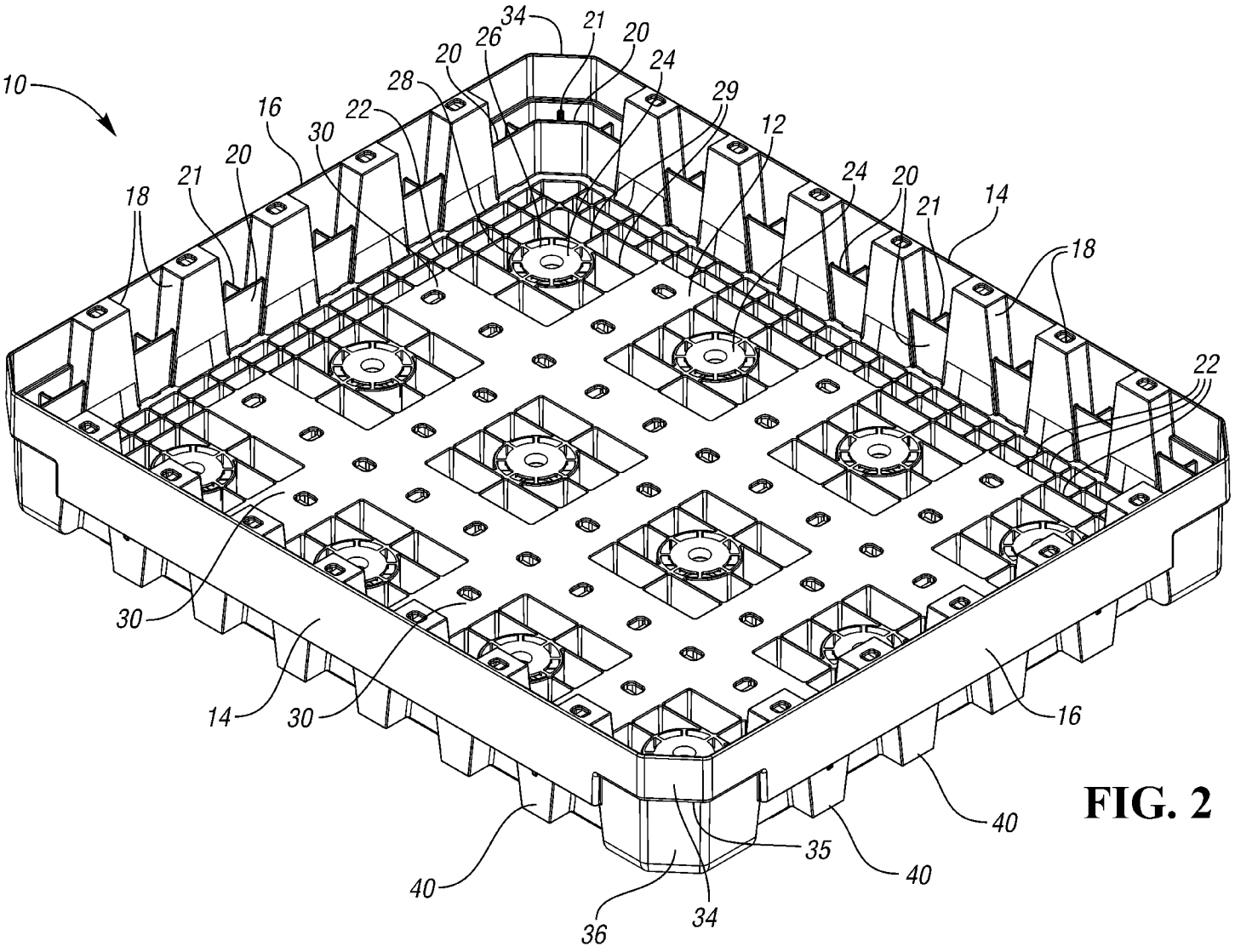
FIG. 2 is a perspective view of the first tray of FIG. 1.

FIG. 2 is a perspective view of the first tray 10. The example first tray 10 is formed as a single piece of plastic, such as by injection molding, but other methods could be used. The tray 10 includes a base 12, opposed side walls 14 and opposed end walls 16. Spaced-apart upper column portions 18 are formed along the inner periphery of the side walls 14 and end walls 16. The upper column portions 18 taper upward and have an uppermost surface coplanar with the uppermost edges of the side walls 14 and end walls 16. Lower ribs 20 extend between lower portions of adjacent pair of upper column portions 18. Perpendicular ribs 21 extend from each lower rib 20 to a lower portion of the side wall 14 or end wall 16.

Interconnected, transverse peripheral ribs 22 extend about the periphery of the base 12 adjacent and inward of the upper column portions 18. Container support areas each include a center annular wall 24, radial ribs 26, an annular rib 28 and interconnected, transverse ribs 29 extending outward from the annular rib 28. Horizontal strips 30 extend longitudinally and laterally across the support surface of the base 12, generally along the borders of the container support areas.

Angled wall portions 34 cut the corners of the tray 10 and connect the side walls 14 to each adjacent end wall 16. Recessed lower corner walls 36 define a de-nesting notch 35 below each angled wall portion 34. Lower column portions 40 are positioned between and below the upper column portions 18 and extend below the lower edges of the side walls 14 and end walls 16. The lower column portions 40 are tapered downward. Chamfered corners assist with tray separation from adjacent trays when palletized by creating hole for person's hand to slip in-between trays.

Figure 3:
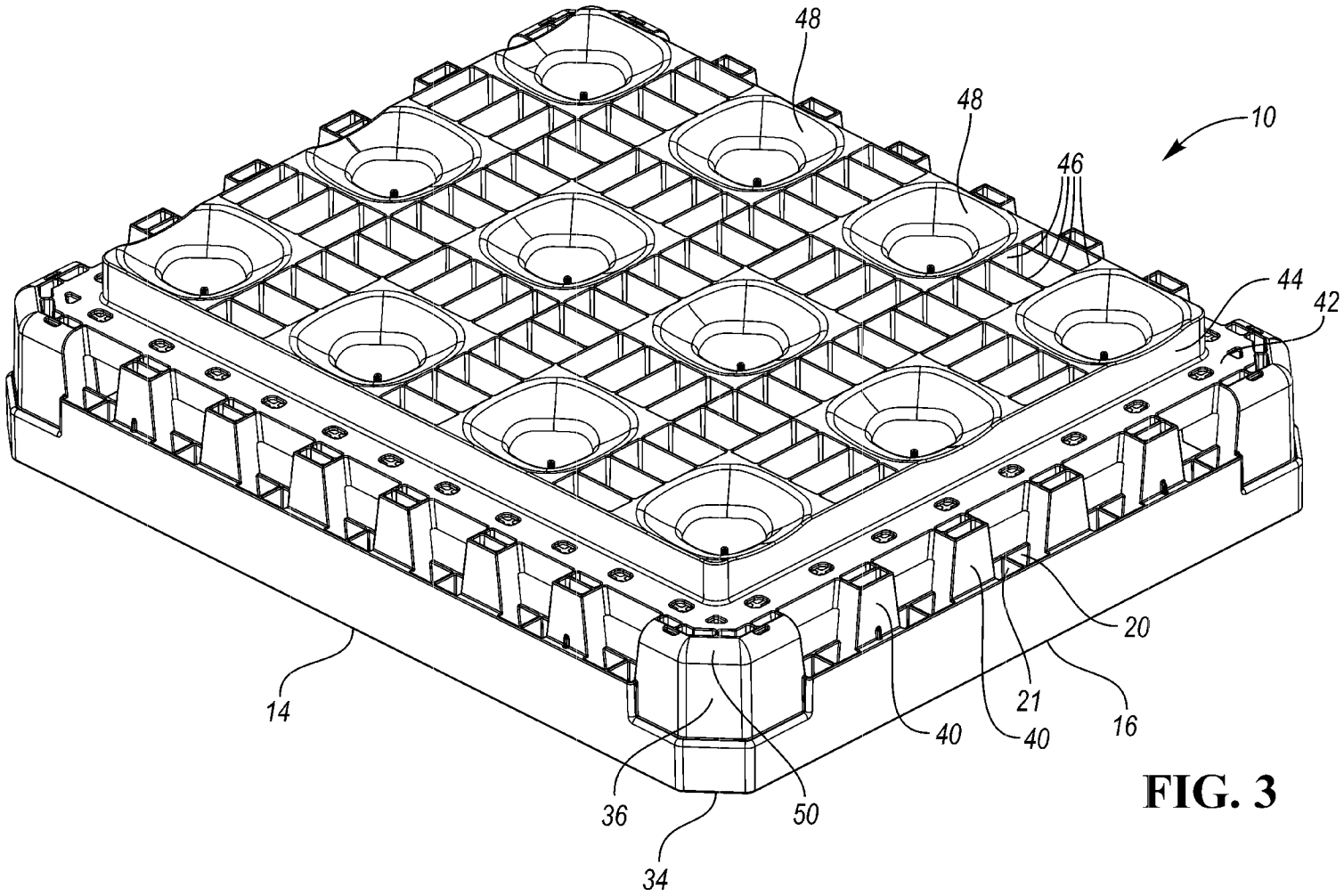
FIG. 3 is a bottom perspective view of the first tray.

FIG. 3 is a bottom perspective view of the tray 10. As shown, the lowermost edges of the lower column portions 40 are coplanar with a horizontal peripheral wall portion 42, which extends about the periphery of the base 12. The horizontal peripheral wall portion 42 is inward of the lower column portions 40. The plurality of peripheral ribs 22 of FIG. 2 extend downward to the horizontal peripheral wall portion 42. This provides strong support between fork tines and the upper surface of the base 12 of the tray 10. A lower peripheral rib 44 projects downward generally perpendicularly at an inner edge of the horizontal peripheral wall portion 42. A central portion of the base 12 is defined by the lower peripheral rib 44. The central portion includes the lower peripheral rib 44 and a plurality of interconnected, transverse ribs 46. The central portion further includes concave, angled and/or contoured, somewhat conical surfaces 48 that are complementary to the upper surfaces of the large containers 90 (FIG. 1). The interconnected, transverse ribs 46 extend downward from the horizontal strips 30 shown in FIG. 2 to provide strong support from the weight of the containers 90 down to the floor. The radial ribs 26, the annular rib 28 and the interconnected, transverse ribs 29 of each container support area shown in FIG. 2 extend upward from the contoured surfaces 48 of FIG. 3. This provides strong support between the lower surfaces of the containers 90 in the tray 10 down to the upper surfaces of the containers 90 stacked therebelow.

The central portion of the base 12 extends lower than the horizontal peripheral wall portion 42 and the lower column portions 40, such that while the central portion is supported on a floor, the horizontal peripheral wall portion 42 and the lower column portions 40 provide surfaces that can be lifted by fork tines or the like.

Bottom edges 50 of the recessed lower corner areas 36 may be contoured convexly and can be used to manually lift a loaded tray 10 (by more than one person). The contours also improve the ergonomics for lifting the tray 10.

Figure 4:
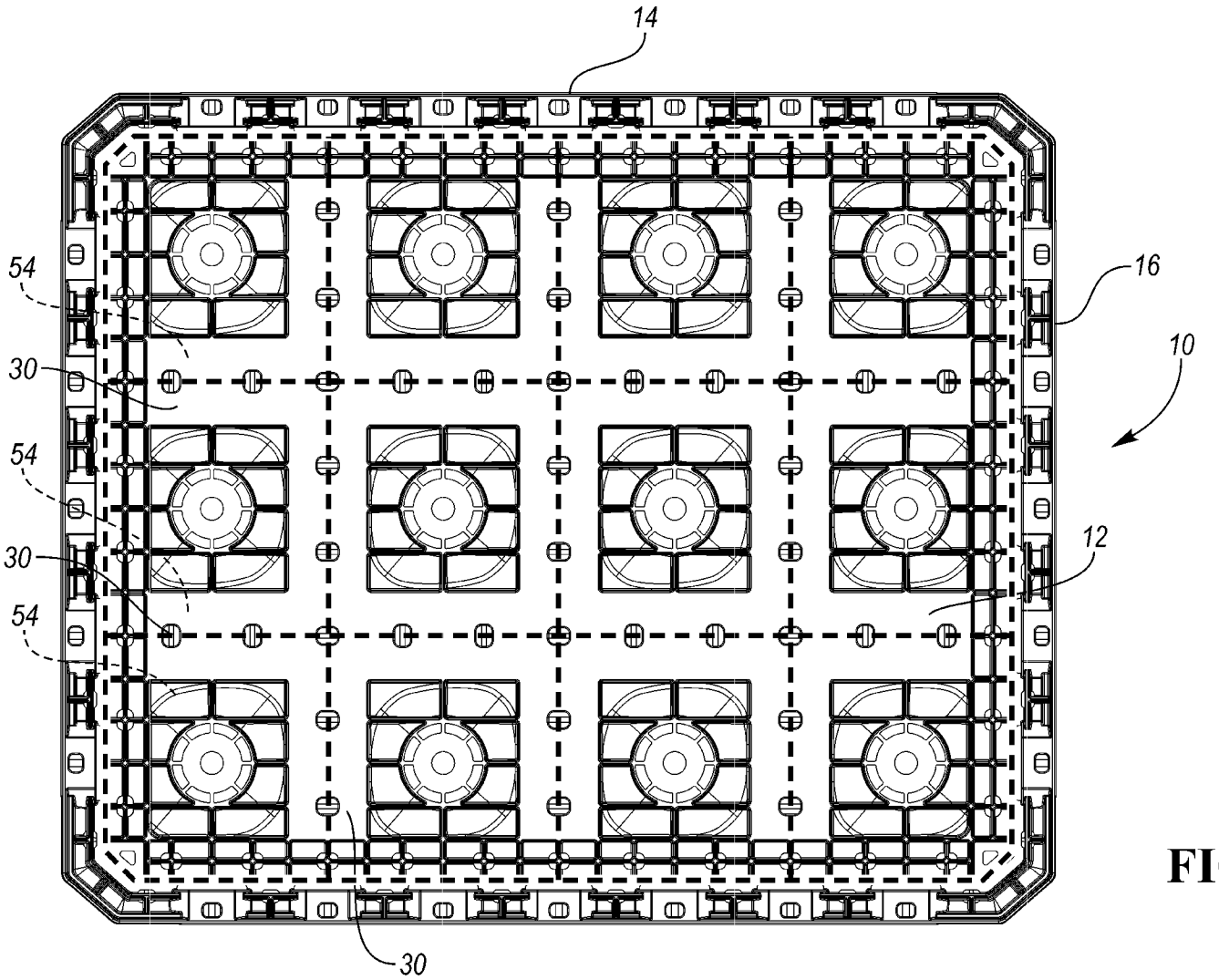
FIG. 4 is a top view of the first tray.

FIG. 4 is a top view of the first tray 10. Dashed lines in FIG. 4 show the general delineation of the 12 container support areas 54 defined on the base, which has some correlation to the horizontal strips 30 in the base 12.

Figure 5:
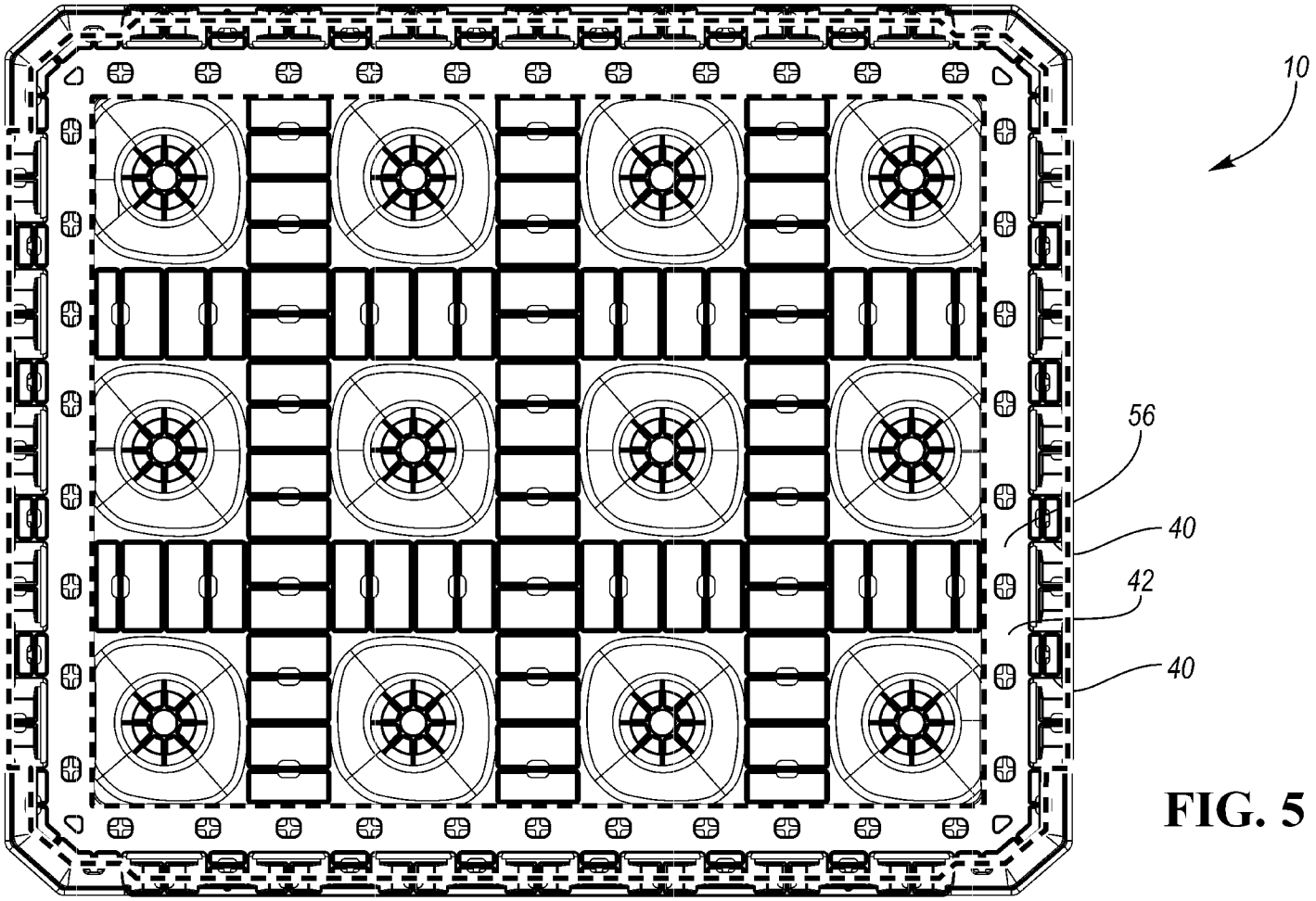
FIG. 5 is a bottom view of the first tray.

FIG. 5 is a bottom view of the first tray 10. In FIG. 5, between the dashed lines is defined a load bearing periphery 56 that can be used to contact fork tines or other support surfaces to support the tray 10. The load bearing periphery 56 includes a plurality of coplanar surfaces, including the horizontal peripheral wall portion 42 and the lowermost edges of the lower column portions 40. The load-bearing periphery is wide enough to be supported on fork tines, for example, at least 1.5" wide.

Figure 6:
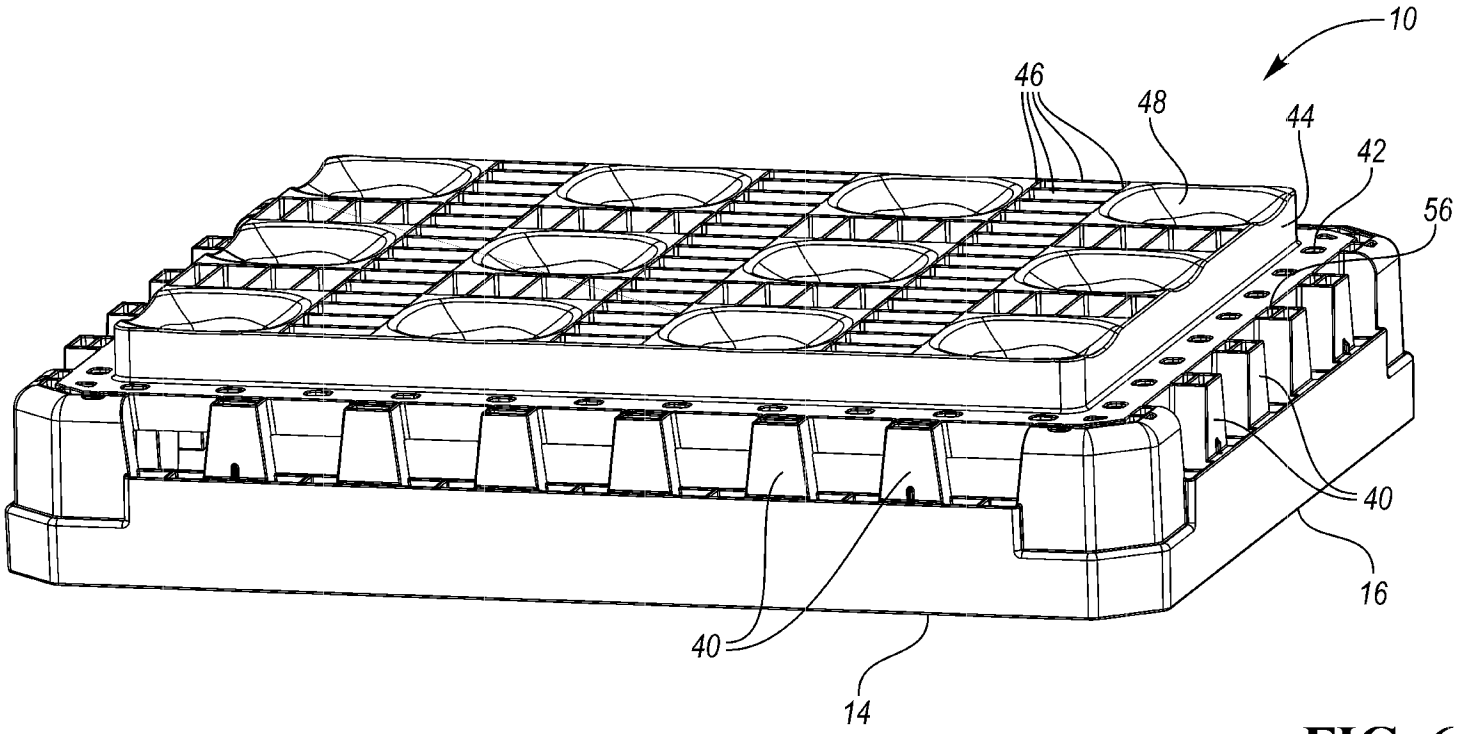
FIG. 6 is a bottom perspective view of the first tray.

FIG. 6 is a bottom perspective view of the tray 10. As shown, the central portion of the bottom of the tray 10 is lower than the load bearing periphery 56, which includes horizontal peripheral wall portion 42 and the lower edges of the lower column portions 40. The central portion includes the plurality of transverse ribs 46 and the peripheral rib 44.

Figure 7:
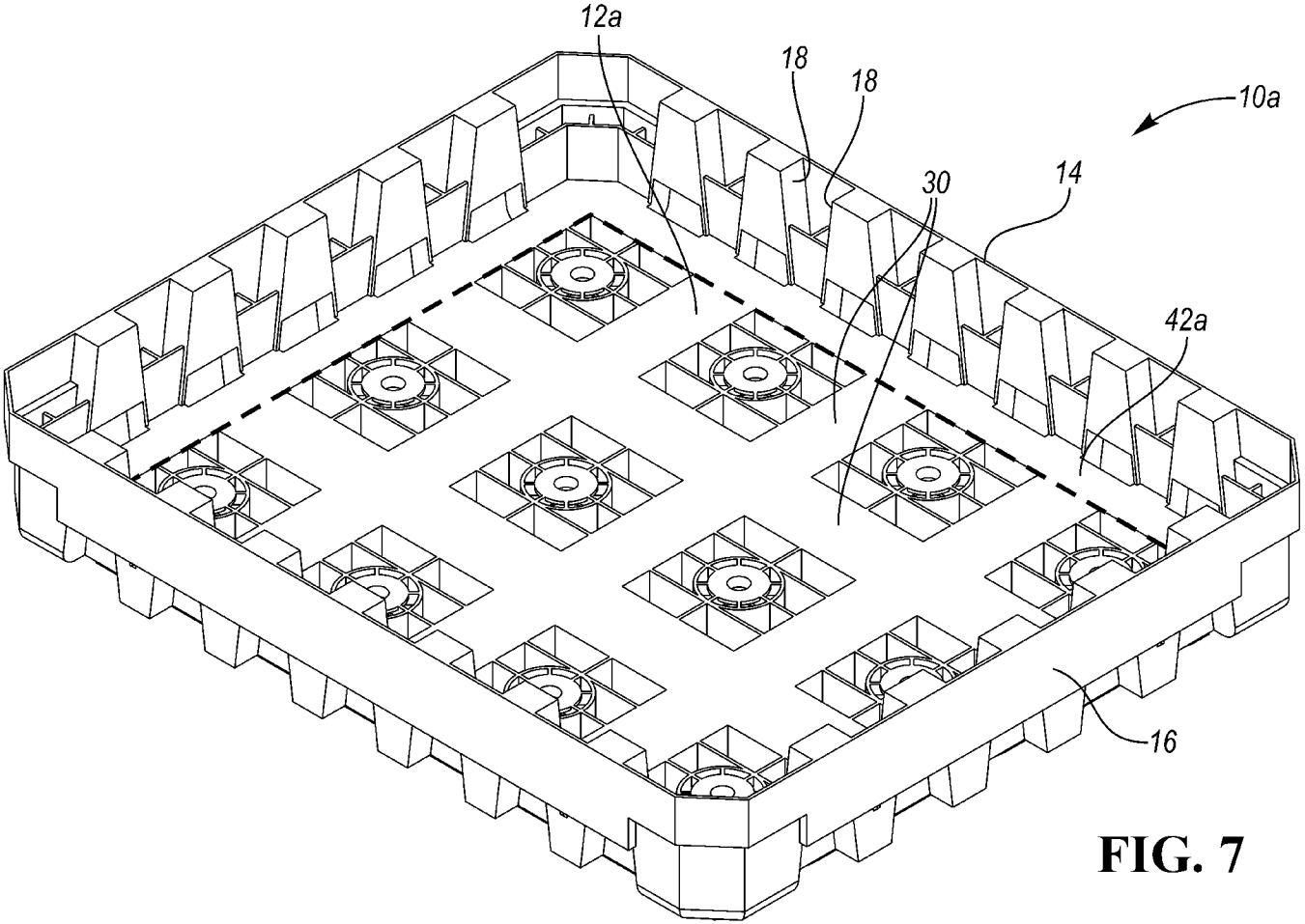
FIG. 7 is a perspective view of an alternative first tray.

FIG. 7 is a perspective view of an alternative first tray 10*a*. The first tray 10*a* is identical to the first tray 10 of FIGS. 1-6 except as otherwise described below or shown in the drawings. The tray 10*a* has a base 12*a* and the same sidewalls 14 and end walls 16 as before. The periphery of the base 12*a* includes an upper horizontal peripheral wall 42*a*. (In the first embodiment, this area included a plurality of ribs.)

Figure 8:
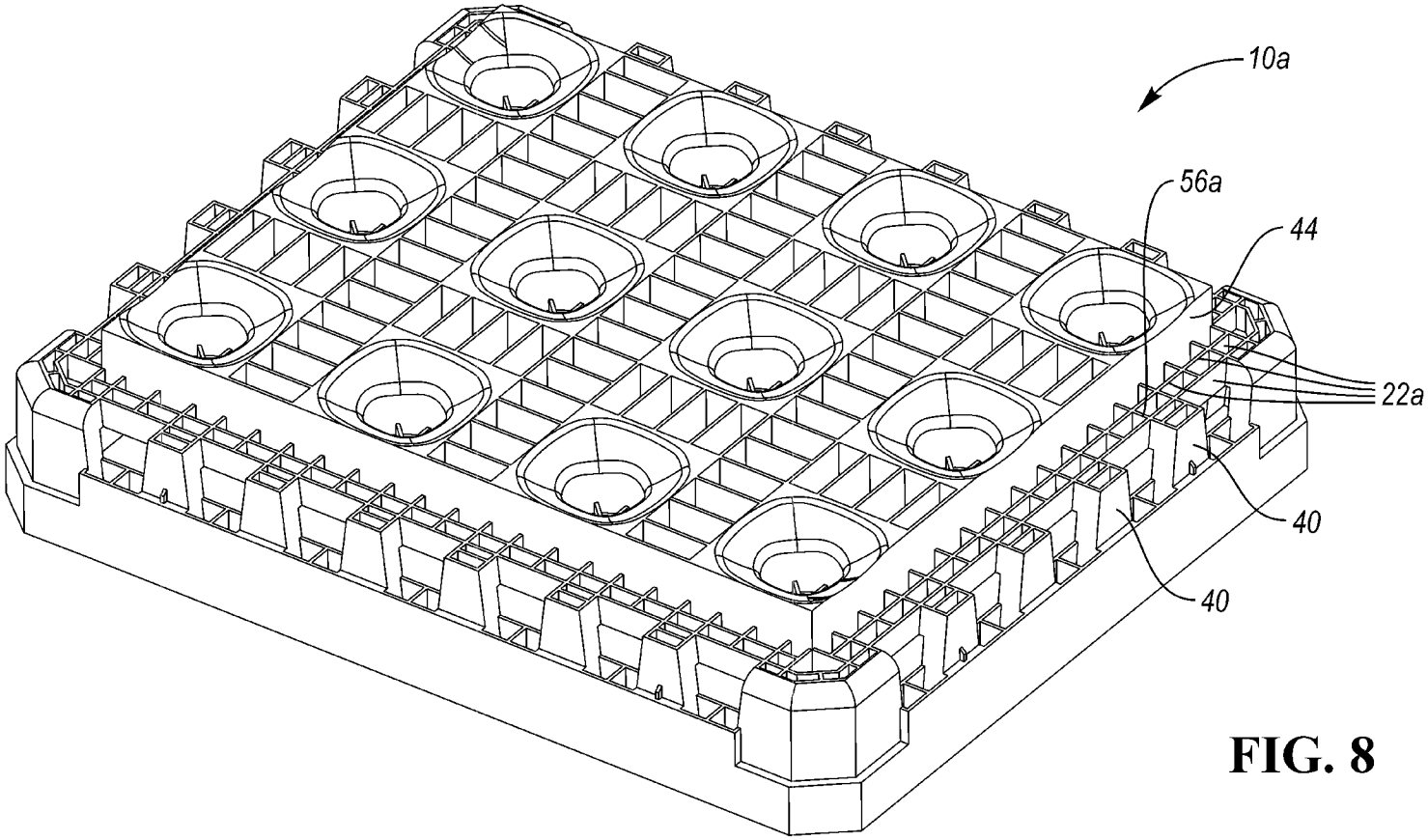
FIG. 8 is a bottom perspective view of the alternative first tray.

FIG. 8 is a bottom perspective view of the alternative first tray 10*a*. As shown, in this embodiment, the load bearing area 56*a* around the periphery of the tray 10*a* is defined by a plurality of interconnecting transverse ribs 22*a* that extend downward from the horizontal peripheral wall 42*a* (FIG. 7). This embodiment is not as strong as the first embodiment but provides a more continuous surface on the top of the base in contact with the containers.

Figure 9:
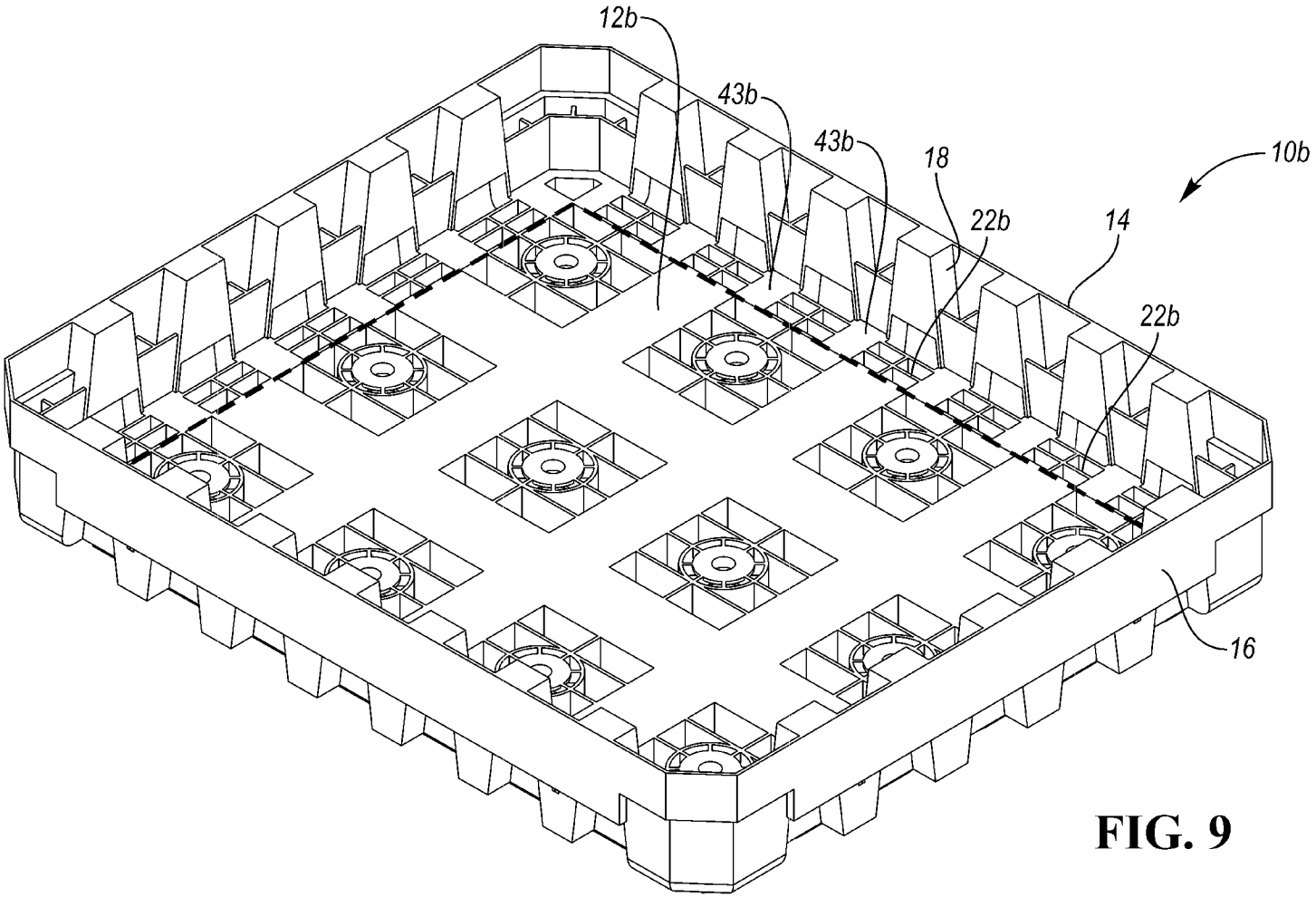
FIG. 9 is another alternative tray.
Figure 10:
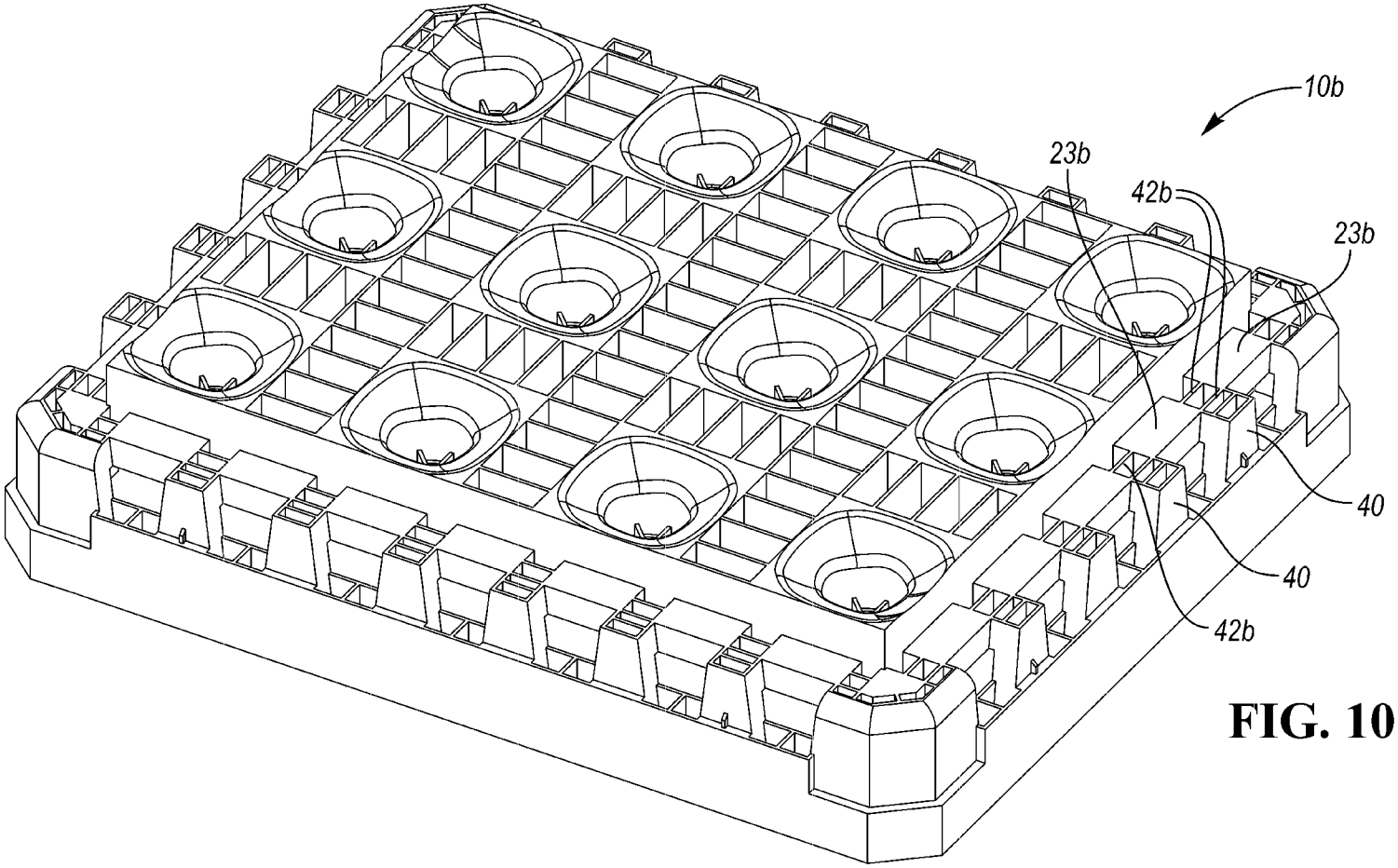
FIG. 10 is a bottom perspective view of the tray of FIG. 9.
Figure 11:
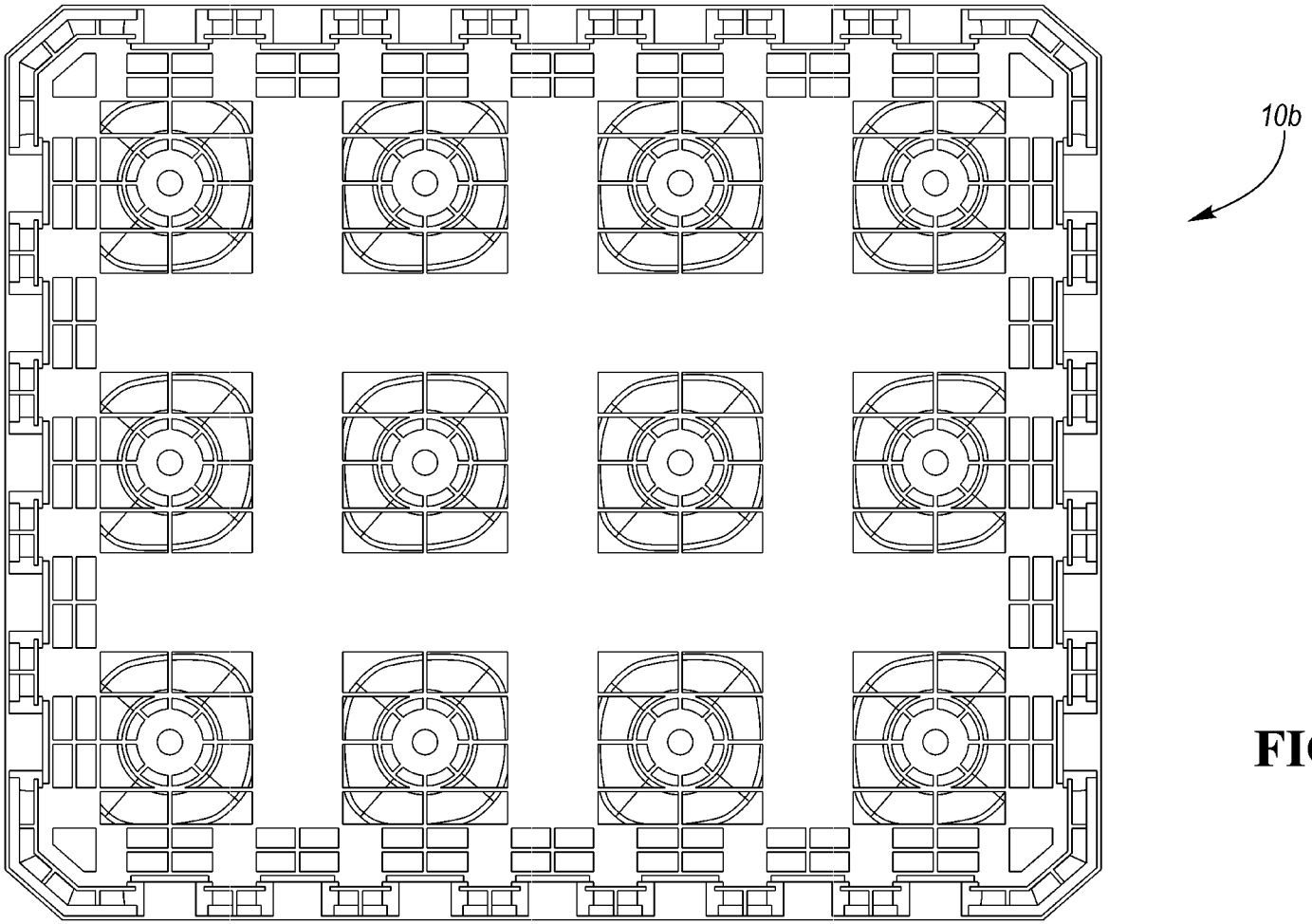
FIG. 11 is a top view of the tray of FIG. 9.
Figure 12:
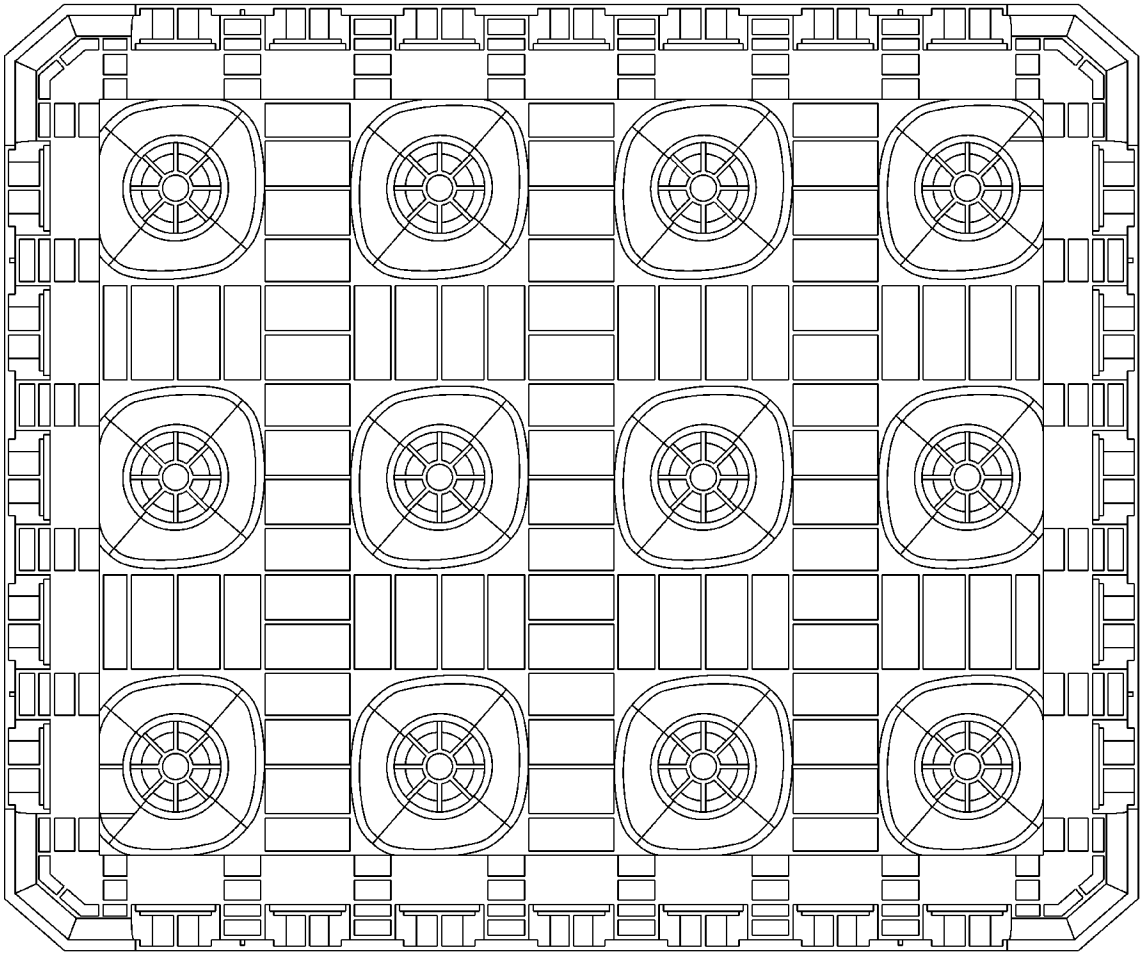
FIG. 12 is a bottom view of the tray of FIG. 9.

FIG. 9 is another alternative tray 10*b* in which the periphery of the base 12*b* includes alternating upper horizontal walls 43*b* and interconnecting transverse ribs 22*b*. On the underside of the tray 10*b*, shown in FIG. 10, the tray 10*b* includes alternating lower wall surfaces 23*b* and ribs 42*b*. The ribs 42*b* extend downward from the upper horizontal walls 43*b* (FIG. 9). The lower wall surfaces 23*b* are at lower ends of the ribs 22*b* (FIG. 9). FIG. 11 is a top view of the alternate tray 10*b*. FIG. 12 is a bottom view of the alternate tray 10*b*. This embodiment is a compromise or hybrid between the first two embodiments.

Figure 13:
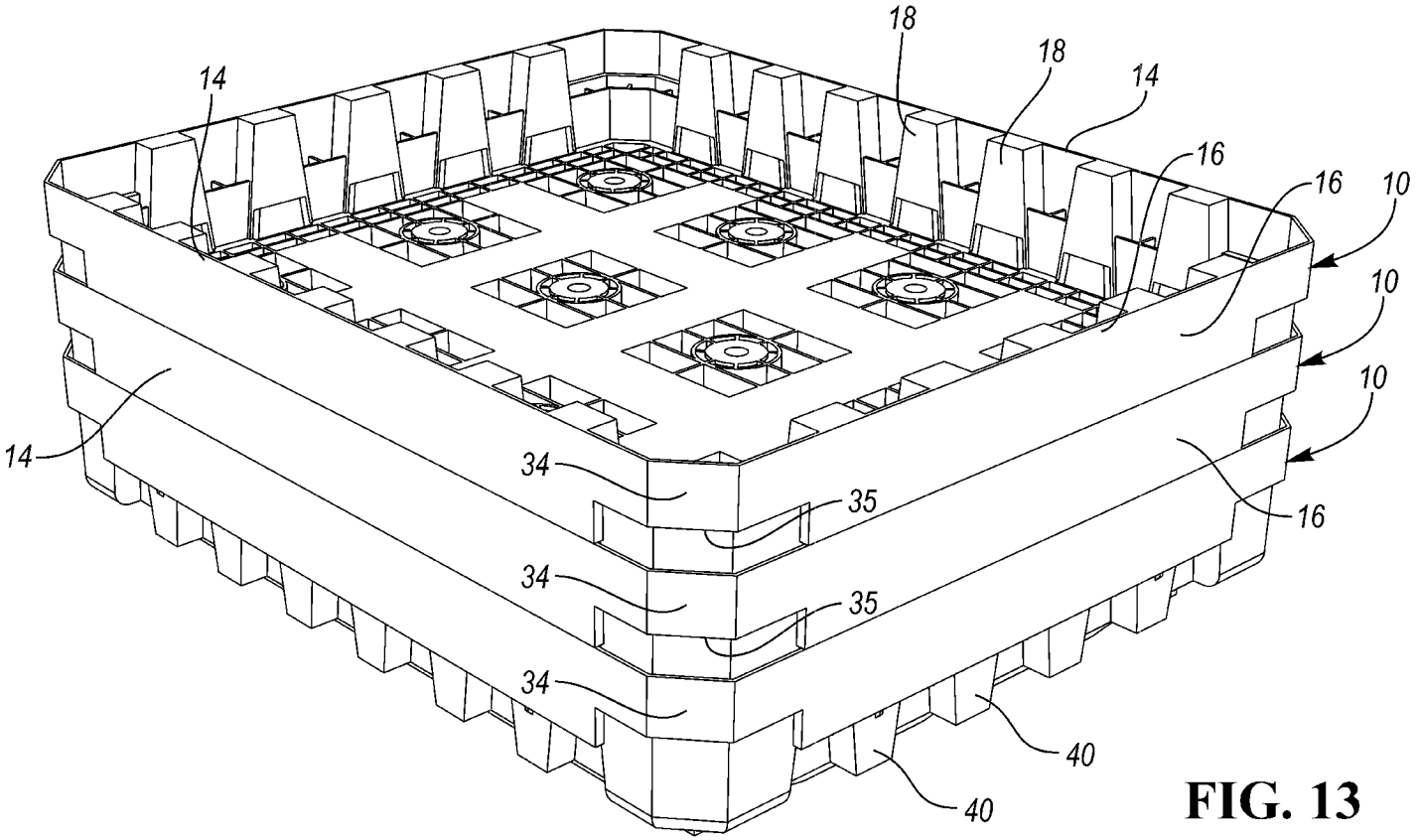
FIG. 13 shows three of the trays of FIG. 2 nested and empty.

FIG. 13 shows three of the trays 10 nested and empty. The alternate trays 10*a* and 10*b* would nest the same way. When nested, the lower column portions 40 of an upper tray 10 are received between the upper column portions 18 of the lower tray 10 until the lower edges of the side walls 14 and end walls 16 the upper edges of the side walls 14 and end walls 16 of the lower tray. This exposes the de-nesting notch 35 which facilitates removing the upper tray from the lower tray.

Figure 14:
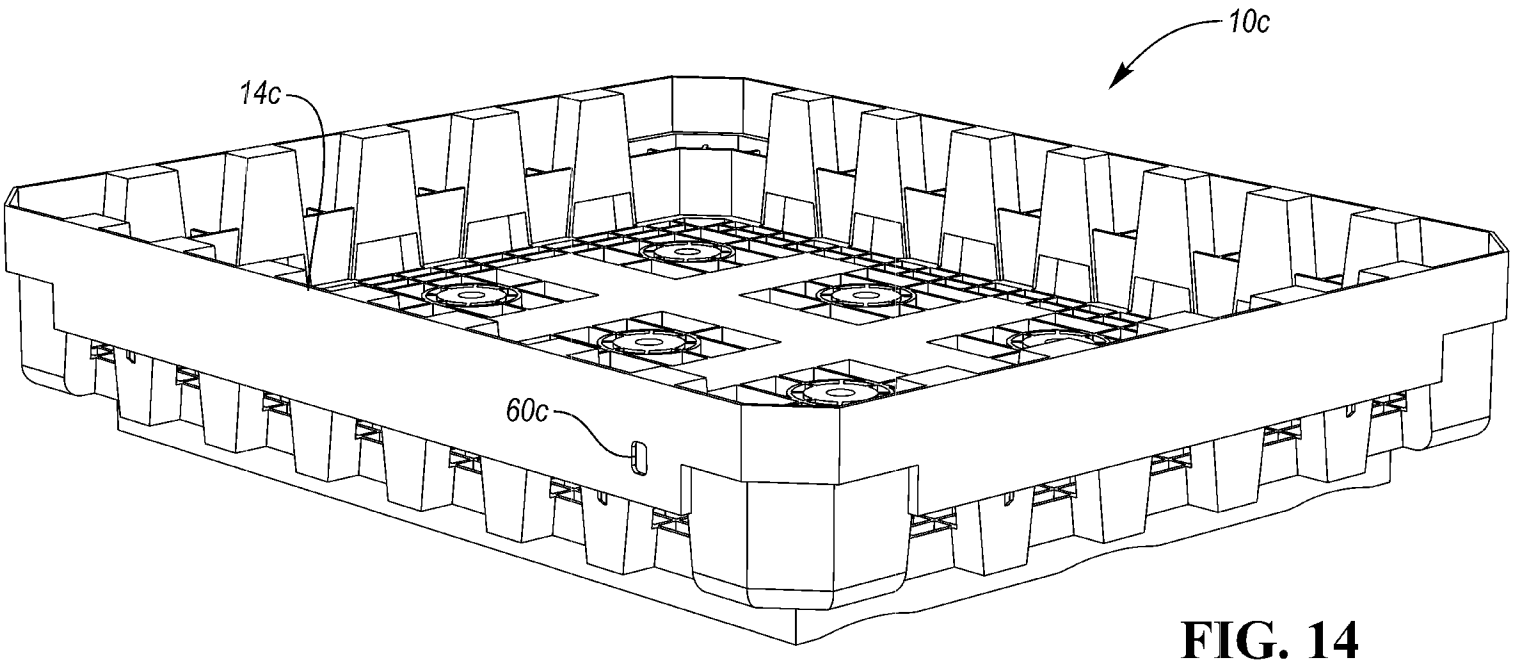
FIG. 14 shows another alternate first tray.

FIG. 14 shows another alternate first tray 10*c*, having a first visual identifier 60*c*, which in this example is a hole through one of the side walls 14*c*. The hole 60*c* in the side wall 14*c* may be visible by an electric eye of automatic handling equipment to verify the orientation of the tray 10*c* or to distinguish a first tray 10*c* from a second tray 110 (FIG. 1).

Figure 15:
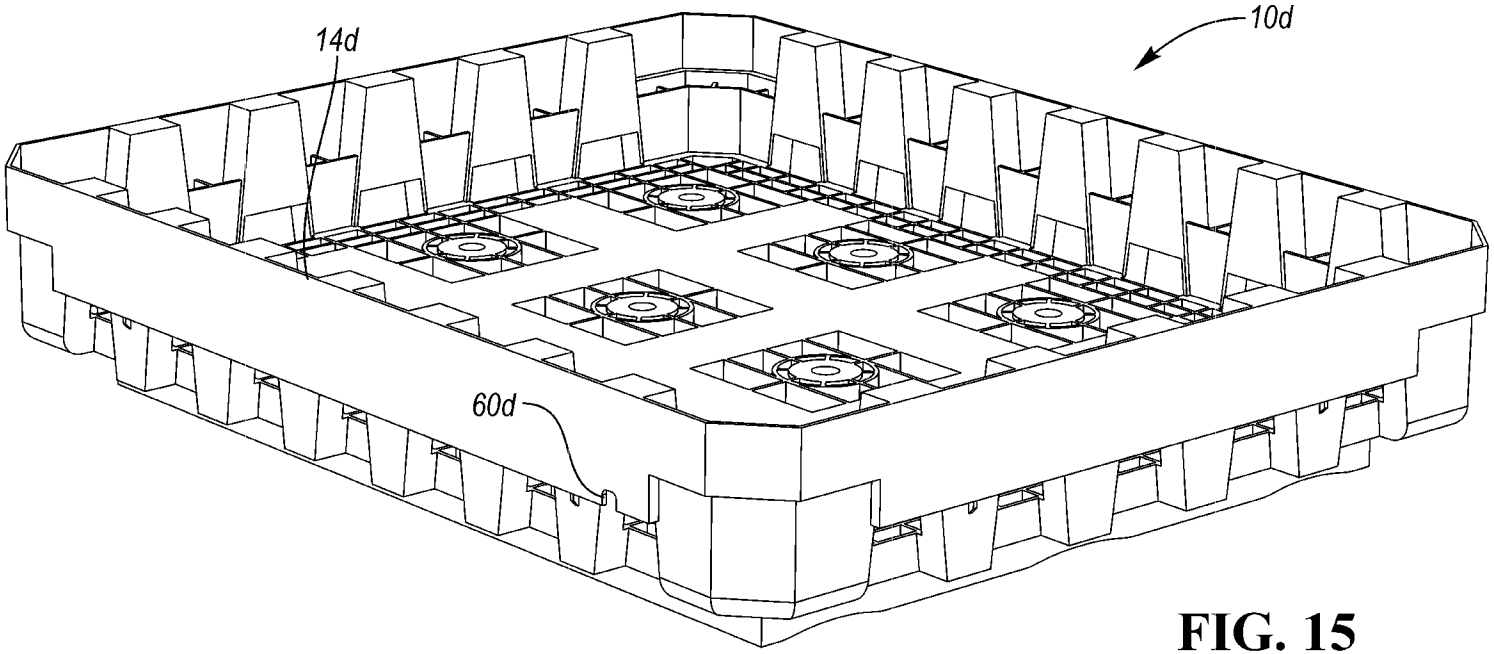
FIG. 15 is a perspective view of another alternate first tray.

FIG. 15 is a perspective view of another alternate first tray 10*d* in which a visual identifier 60*d* formed in side wall 14*d* is a notch 60*d* at a lower edge of one of the side walls 14*d*.

Figure 16:
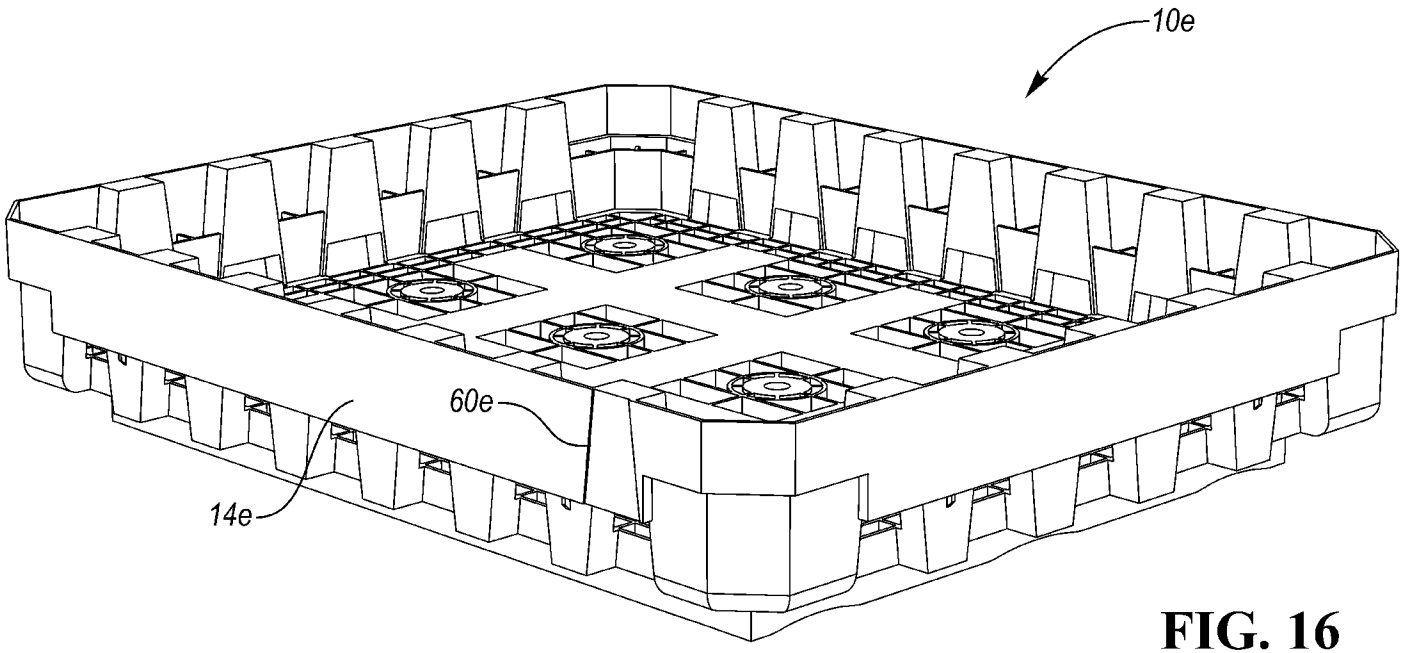
FIG. 16 is a perspective view of another alternate first tray.

FIG. 16 is a perspective view of another alternate first tray 10*e* in which a visual identifier 60*e* formed in side wall 14*e* is a recessed portion.

Figure 17:
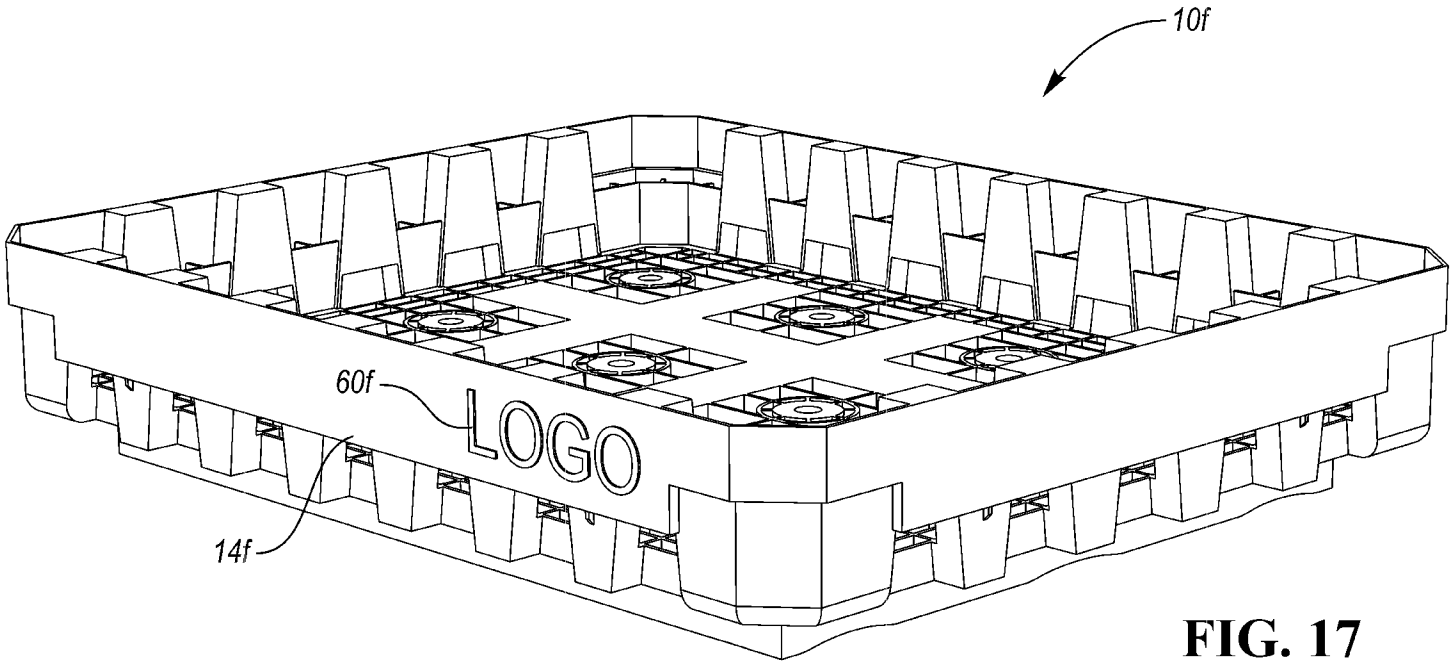
FIG. 17 is a perspective view of another alternate first tray.

FIG. 17 is a perspective view of another alternate first tray 10*f* in which a visual identifier 60*f* formed in side wall 14*f* is a raised logo and/or characters. The variations in the alternate first trays 10*a-f* could also be incorporated into second tray 110.

Figure 18:
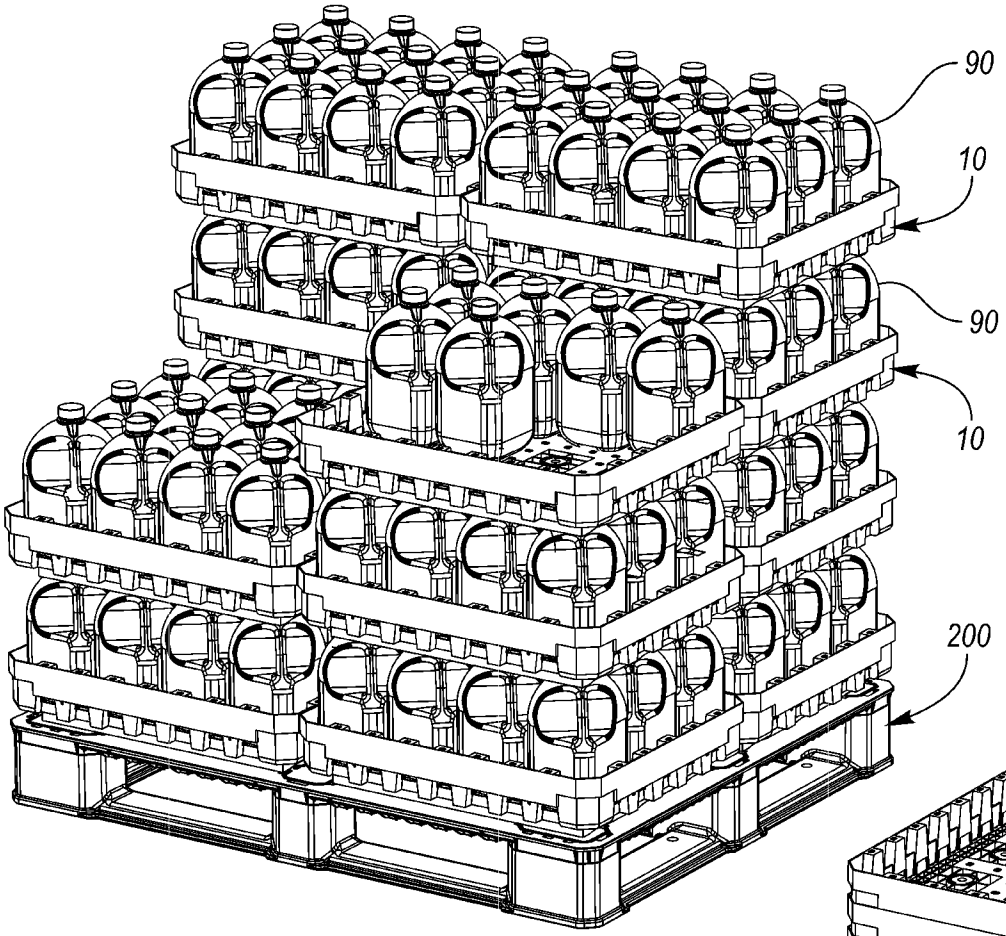
FIG. 18 shows a plurality of the first trays of FIG. 2 loaded with containers and stacked on one another on a pallet.
Figure 19:
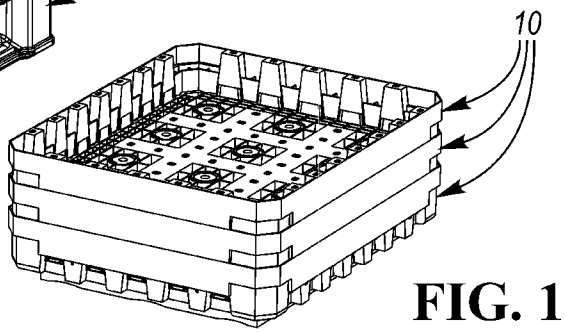
FIG. 19 shows three of the first trays of FIG. 18 empty and nested.

As shown in FIG. 18, a plurality of the first trays 10 can be loaded with containers 90 and stacked on one another on a pallet 200. The trays 10, containers 90 and pallet 200 are shipped to a store where they are sold to customers. When the trays 10 are empty, they can be nested as shown in FIG. 19. Generally, the lower column portions 40 of an upper tray 10 are received between the upper column portions 18 of the lower tray 10 and the base 12 of the upper tray 10 is received between the upper column portions 18 of opposed side walls 14 and opposed end walls 16 of the lower tray 10.

Figure 20:
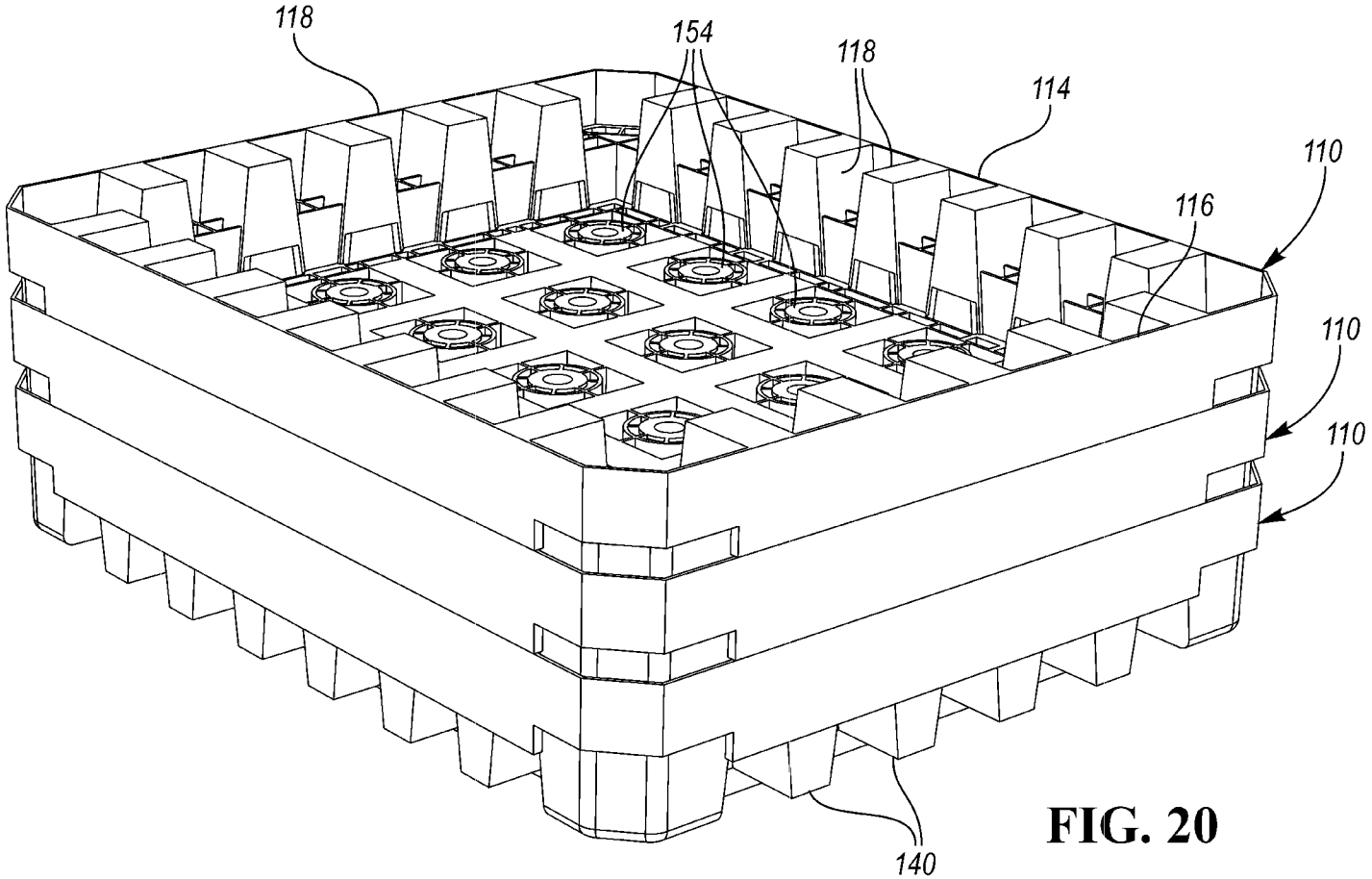
FIG. 20 shows a plurality of the second trays of FIG. 1 empty and nested.

FIG. 20 shows a plurality of the second trays 110. The second trays 110 are identical to the first trays 10 except as described or shown differently in the drawings. Generally, the second trays 110 include upper column portions 118 that project inward from the side walls 114 and end walls 116 further than did the upper column portions 18 in the first tray 10. This is to provide a tighter fit with the smaller containers 190 (FIG. 1). The base 112 of the second tray 110 is also arranged in a 4×5 array to accommodate the smaller containers. The depth of the upper column portions 118 may vary based upon the side of the containers and based upon the arrangement on the base 112 (e.g. 3×4, 4×5, 4×4, etc). As also shown in FIG. 20, the empty second trays 110 could also be nested when empty. Again when nested, generally, the lower column portions 140 of an upper tray 110 are received between the upper column portions 118 of the lower tray 110 and the base 112 of the upper tray 110 is received between the upper column portions 118 of opposed side walls 114 and opposed end walls 116 of the lower tray 110.

Many stores will sell both larger containers 90 (FIG. 1) and smaller containers 190 (FIG. 1), so both trays 10, 110 may be used together in the system. Customers can select and remove containers 90, 190 directly out of the trays 10, 110 on the pallet 200 in the store. When a tray 10, 110 is empty, it can be set aside, nested, or stored and the next tray 10, 110 with containers 90, 190 below can be shopped. When a tray 10, 110 is behind a cooler door and half shopped, the containers 90, 190 can slide to the front manually because the inside surface is not broken or pocketed.

Figure 21:
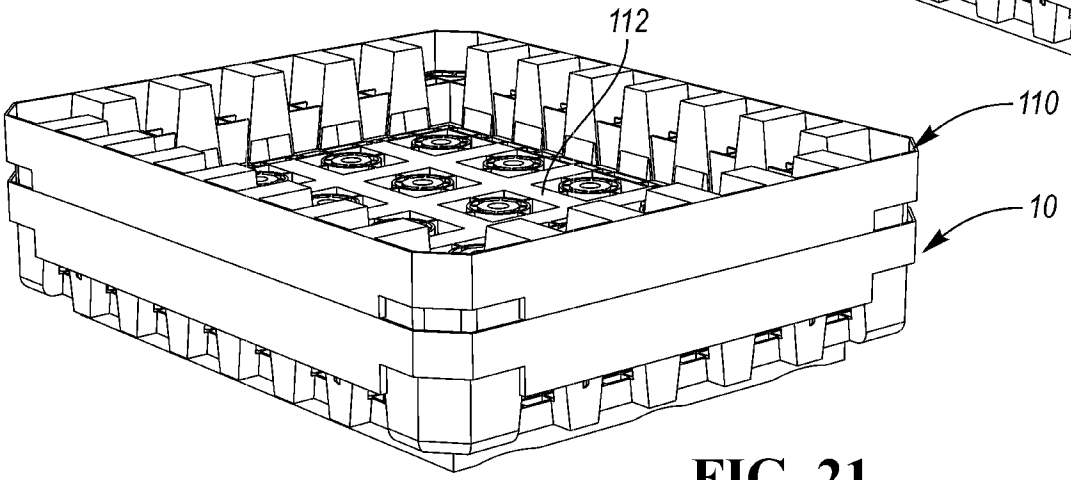
FIG. 21 shows the second tray of FIG. 1 fully nested in the first ray of FIG. 1.

As shown in FIG. 21, the empty second tray 110 can be fully nested into the first tray 10 (i.e. the base 112 is received below the upper edge of the upper column portions 18 and the upper edges of the side walls 14 and end walls 16).

Figure 22:
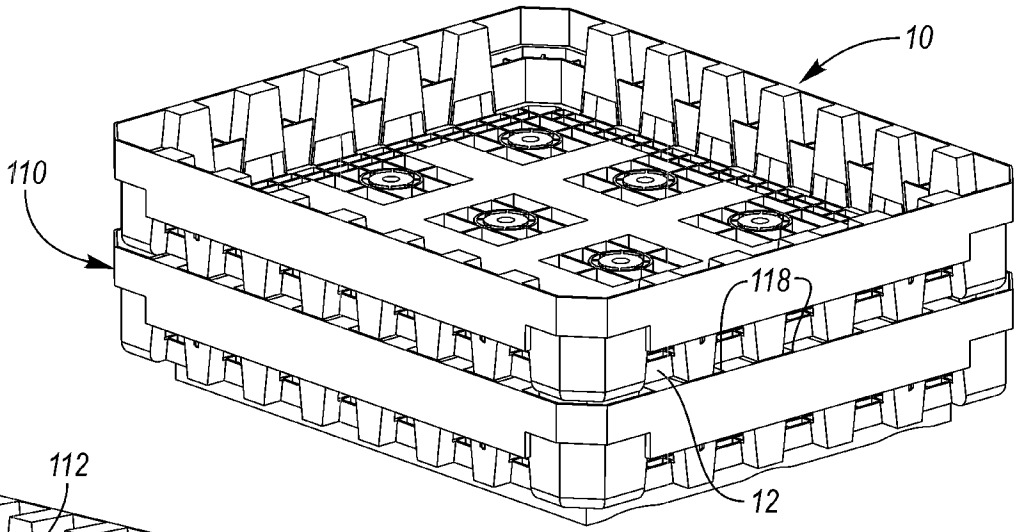
FIG. 22 shows the first tray of FIG. 1 partially nested in the second tray of FIG. 1.

As shown in FIG. 22, the first tray 10 only partially nests into the second tray 110. The base 12 is supported on the upper edges of the deeper upper column portions 118.

The trays 10, 110 are compatible with a wide variety of general conveyance equipment, including but not limited to the following: chain, roller, and flat belt conveyors. It contains a base 12, 112 that is mostly coplanar. Any type of conveyance equipment can grab the tray 10, 110 because the ribs making up the cross section of the base 12, 112 also reach the base of the tray for a surface to roll/conveyor, or slide on.

The example trays 10, 110 provide a 4×3 Gallon and a 5×4 Half Gallon footprint trays. The number of bottles on a tray can be adapted and engineered to what best suits a particular pallet or trailer packout. The compatibility of ½ gallon and gallon two trays depend on the bottle count ratios and have been engineered to work together in this example in the same external footprint.

Figure 23:
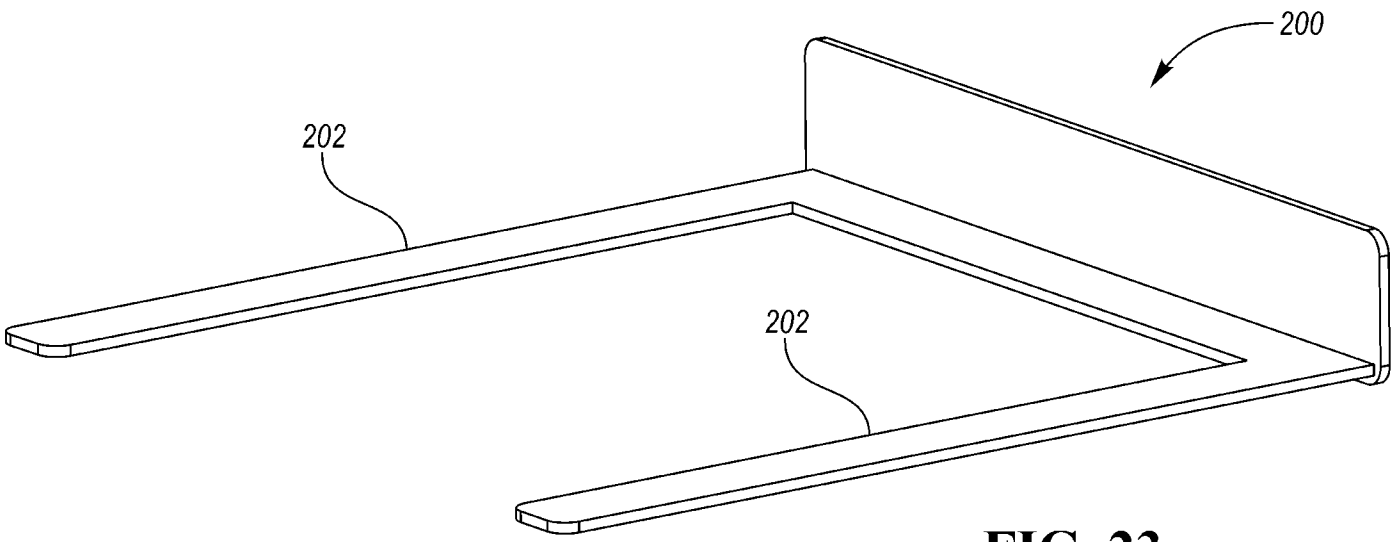
FIG. 23 shows a fork tine set that can be used to lift the any of the trays.

FIG. 23 shows a fork tine set 200 that can be used to lift the any of the trays. The fork tine set 200 can be on any sort of lift for lifting a stack of trays, such as a fork lift, automated handling equipment, etc.

Figure 24:
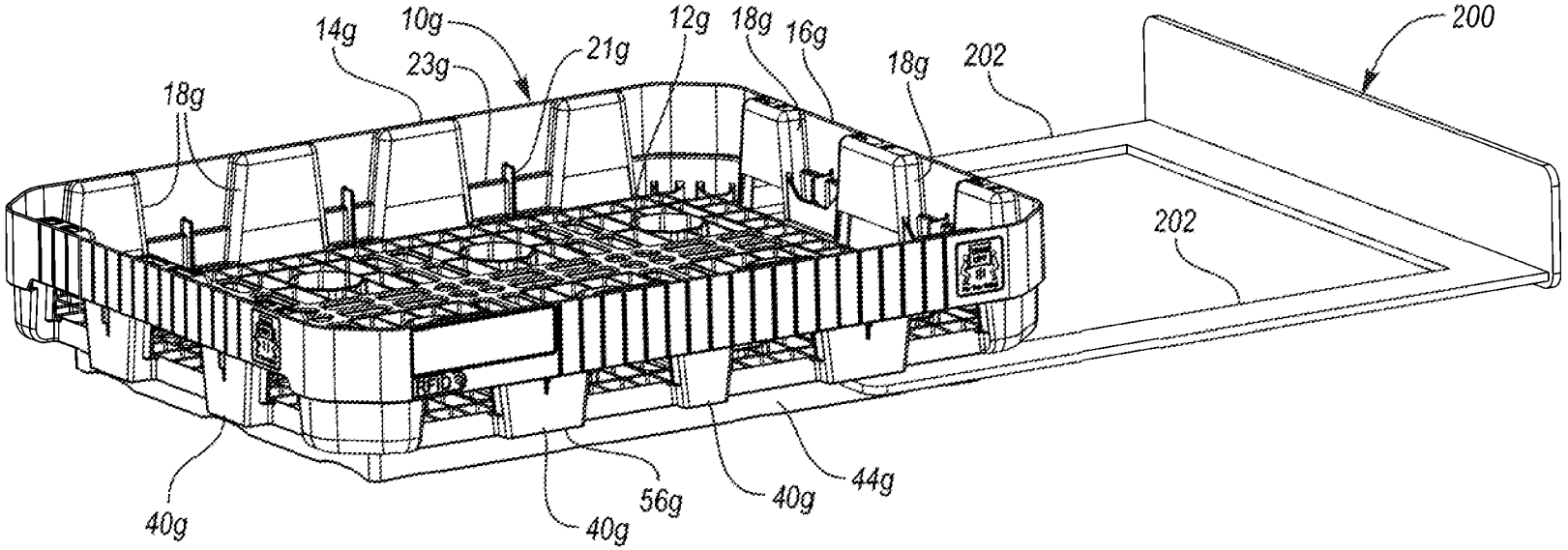
FIG. 24 shows the fork tine set of FIG. 23 beginning to move under an alternate first tray.

FIG. 24 shows the fork tine set 200 of FIG. 23 beginning to move under a tray 10*g*. The tray 10*g* is another alternate tray 10*g*. The tray 10*g* is identical to the tray 10 of FIG. 2 except as otherwise shown or described below. In FIG. 24, the fork tines 202 are moved to a position partially inserted below the load bearing periphery 56*g*, including the lowermost edges of the lower column portions 40*g*.

Figure 25:
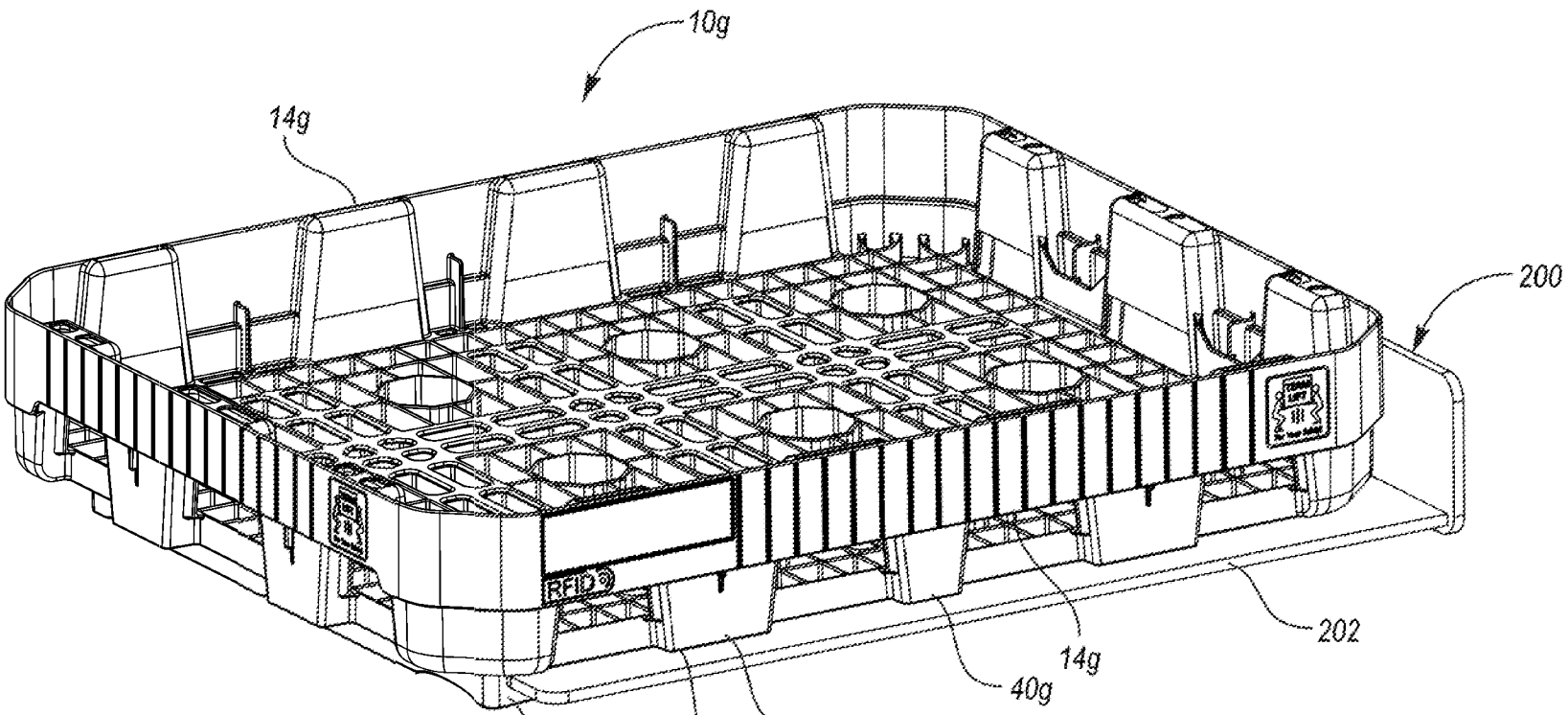
FIG. 25 shows the fork tine set and tray of FIG. 24, with the fork tine set supporting the tray.

FIG. 25 shows the fork tine set 200 and tray of FIG. 24, with the fork tine set supporting the tray 10*g*. The fork tines 202 are received below the load bearing periphery 56*g*, including the lower column portions 40*g*. The central portion of the bottom of the tray 10*g*, including the peripheral rib 44*g*, is received between the fork tines 202, further stabilizing the tray 10*g* on the fork tine set 200. In practice, the fork tine set 200 would be lifting a stack of loaded or empty trays, but only one tray 10*g* is shown for illustration. The fork tine set 200 would work with all of the trays disclosed herein the same way.

Figure 26:
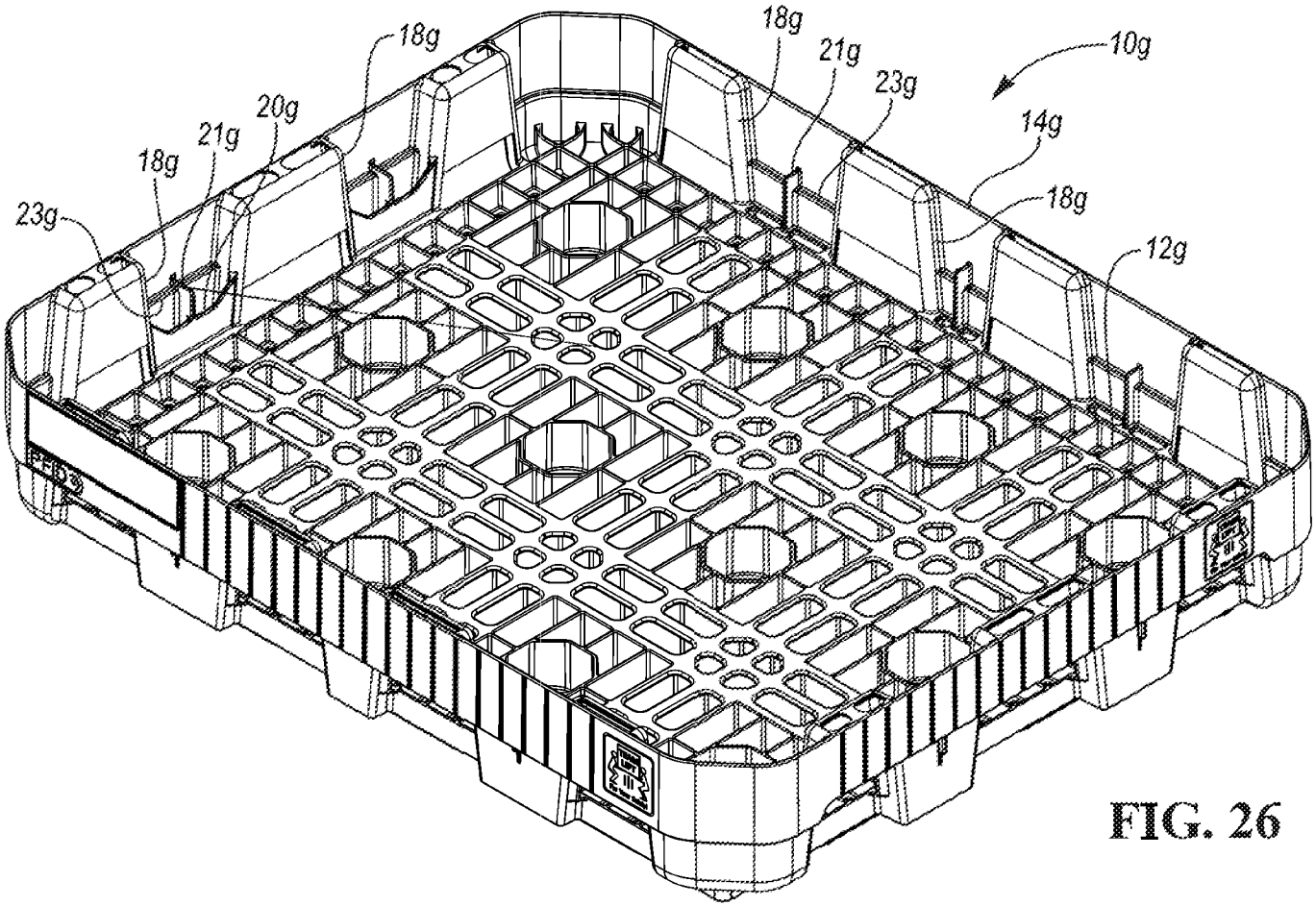
FIG. 26 is a perspective view of the tray of FIG. 24.

FIG. 26 more clearly shows the tray 10*g* of FIG. 24. The tray 10*g* includes a pair of side walls 14*g* and a pair of end walls 16*g*. In this embodiment, there are fewer upper column portions 18*g* (one per container support area) and lower column portions 40*g* and the corners have been rounded. On the side walls 14*g* and end walls 16*g*, the perpendicular ribs 21*g* project inward from outer walls 23*g* of the lower column portions 40*g*, which are connected to and only slightly inwardly offset from the side wall 14*g*. The outer walls 23*g* of the lower column portions 40*g* are a little shorter than the perpendicular ribs 21*g*. On the end walls 16*g* only, there are also lower ribs 20*g* connected to the inner ends of the perpendicular ribs 21*g*. The lower ribs 20*g* are shorter than the perpendicular ribs 21*g* and are generally parallel to the end walls 16*g*.

Figure 27:
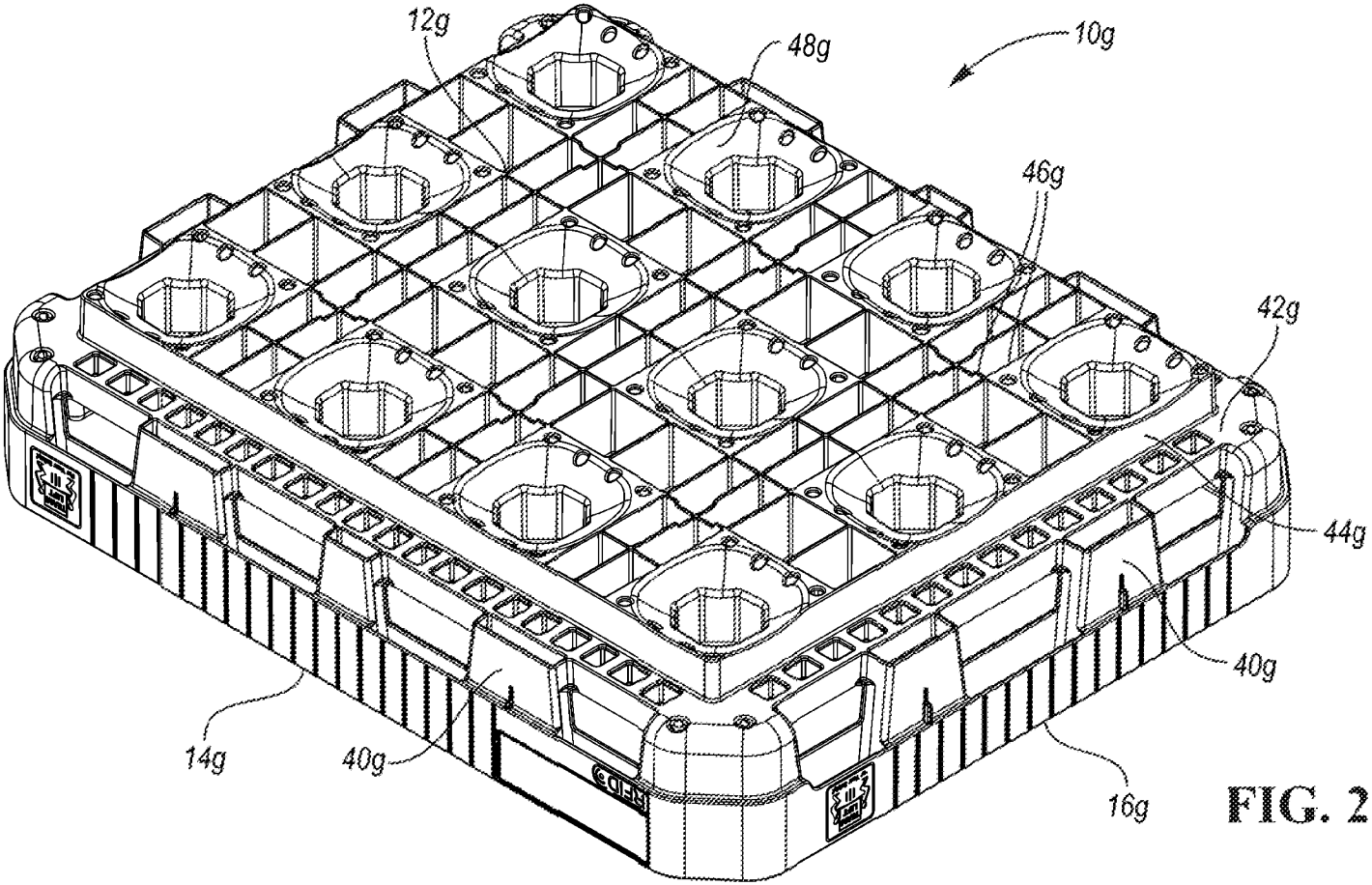
FIG. 27 is a bottom perspective view of the tray of FIG. 26.

FIG. 27 is a bottom perspective view of the tray 10*g*. As shown, the lowermost edges of the lower column portions 40*g* are coplanar with a horizontal peripheral wall portion 42*g*, which extends about the periphery of the base 12*g*. The horizontal peripheral wall portion 42*g* is inward of the lower column portions 40*g*. A lower peripheral rib 44*g* projects downward generally perpendicularly at an inner edge of the horizontal peripheral wall portion 42*g*. A central portion of the base 12*g* is defined by the lower peripheral rib 44*g*. The central portion includes the lower peripheral rib 44*g* and a plurality of interconnected, transverse ribs 46*g*. The central portion further includes concave, angled and/or contoured, somewhat conical surfaces 48*g* that are complementary to the upper surfaces of the large containers 90 (FIG. 1).

The central portion of the base 12*g* extends lower than the horizontal peripheral wall portion 42*g* and the lower column portions 40*g*, such that while the central portion is supported on a floor, the horizontal peripheral wall portion 42*g* and the lower column portions 40*g* provide surfaces that can be lifted by fork tines or the like.

Figure 28:
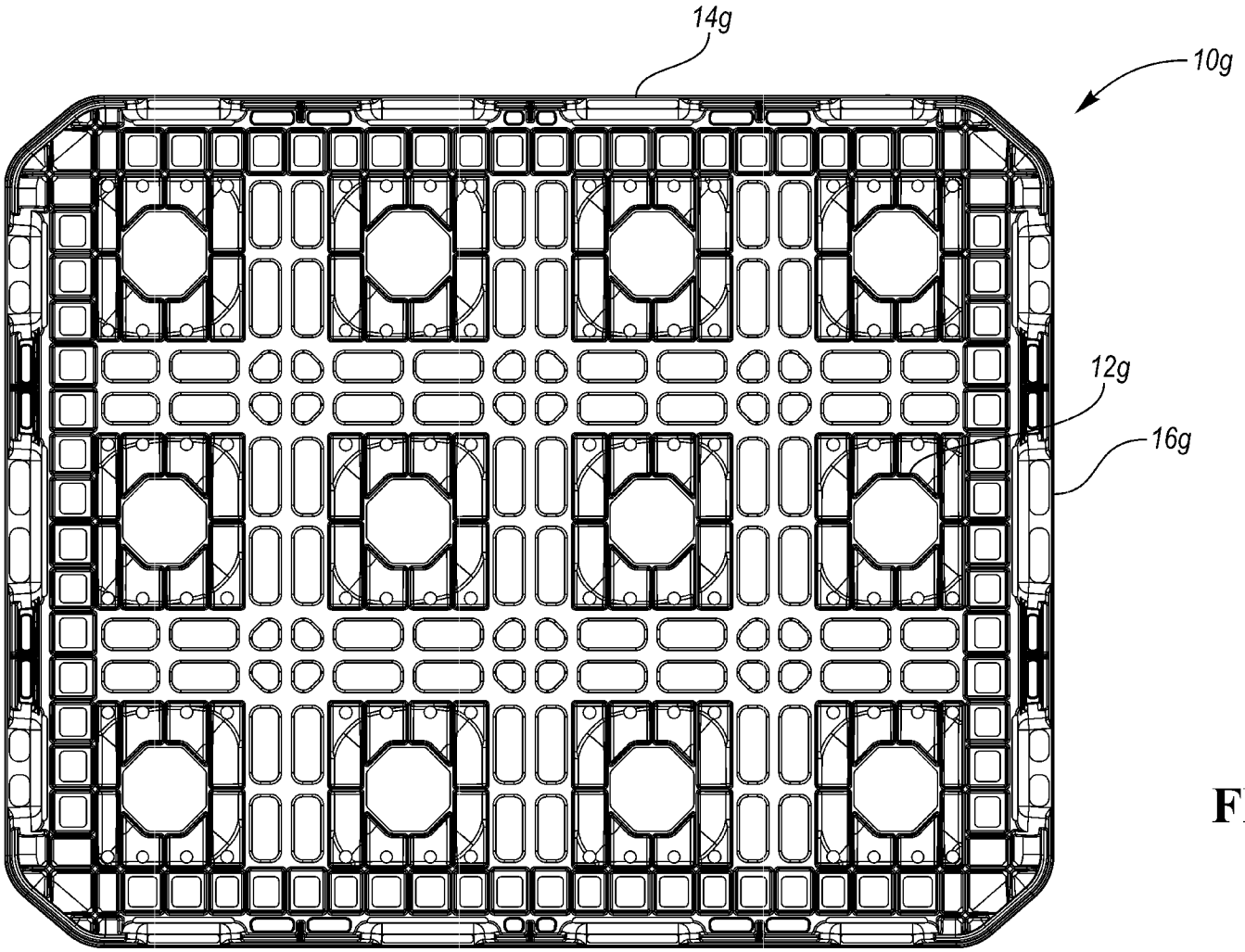
FIG. 28 is a top view of the tray of FIG. 26.
Figure 29:
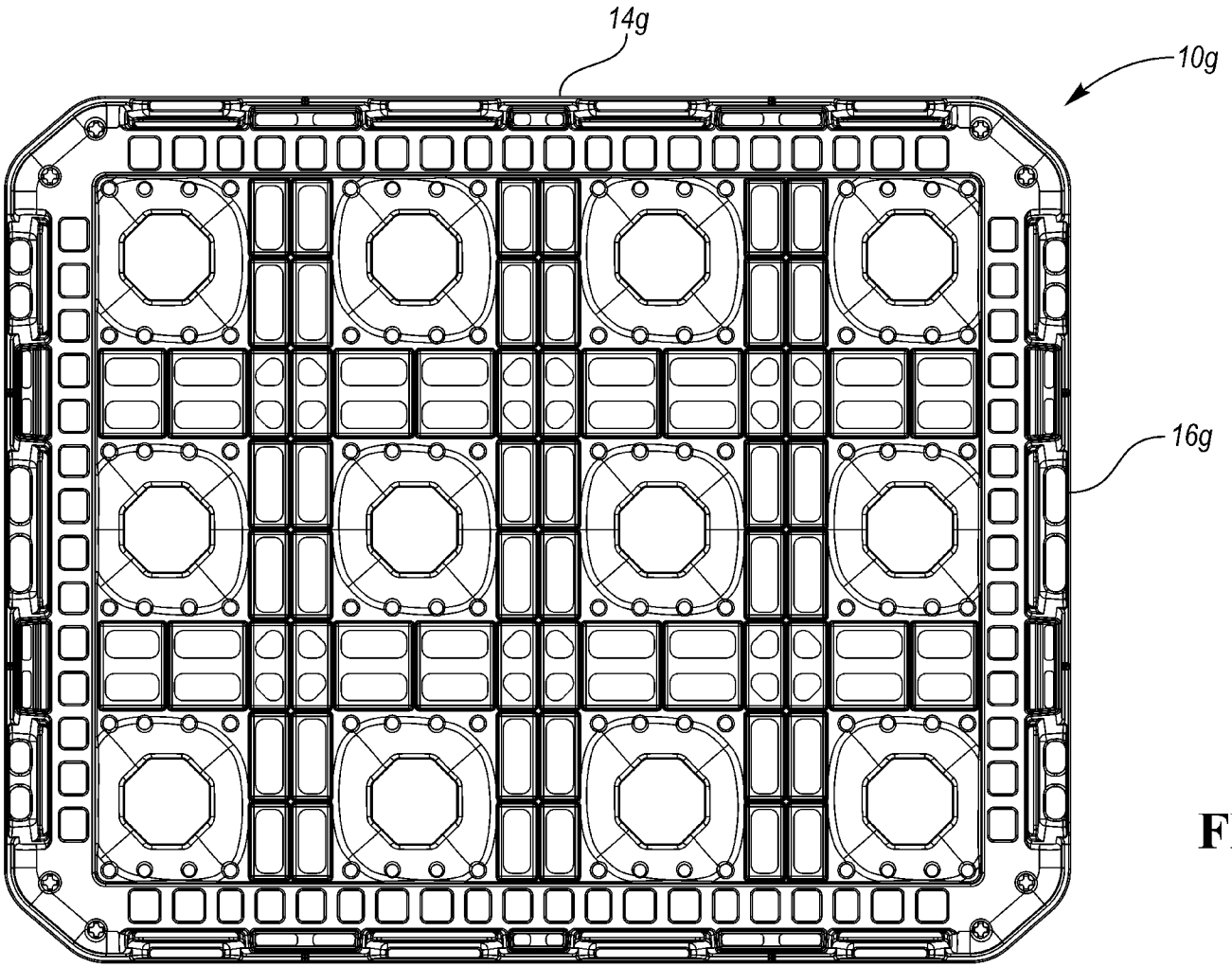
FIG. 29 is a bottom view of the tray of FIG. 26.
Figure 30:
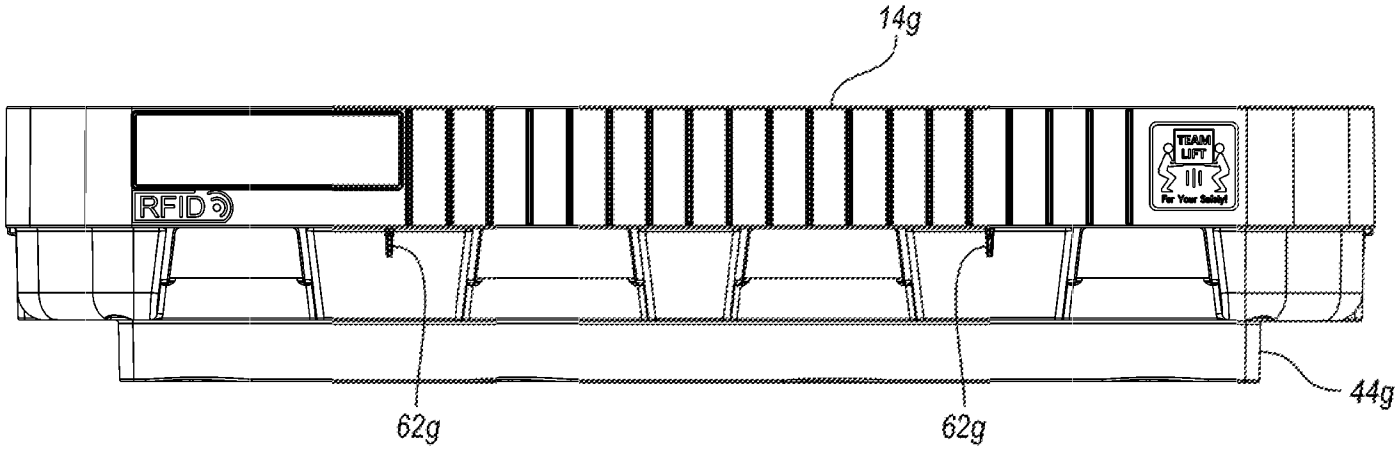
FIG. 30 is a side view of the tray of FIG. 26.
Figure 31:
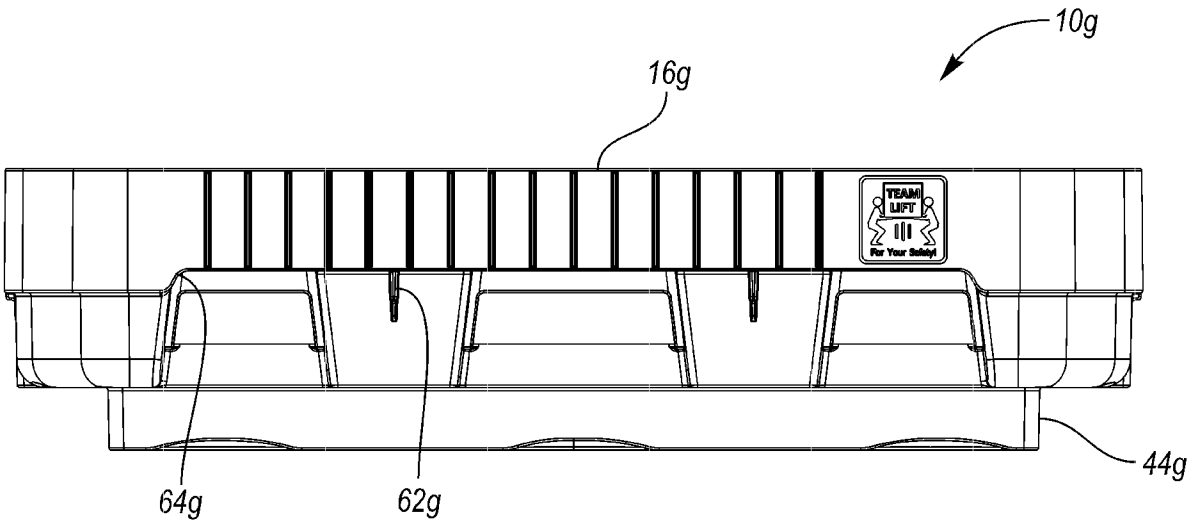
FIG. 31 is an end view of the tray of FIG. 26.

FIG. 28 is a top view of the first tray 10*g*. FIG. 29 is a bottom view of the first tray 10*g*. FIG. 30 is a side view of the tray 10*g* including side wall 14*g*. Stacking ribs 62*g* keep a little space between nested empty trays 10*g* to facilitate separate. FIG. 31 is an end view of the tray 10*g* including end wall 16*g*. A contoured cutaway 64*g* provides a gap for a user to be able to separate nested empty trays 10*g*.

Figure 32:
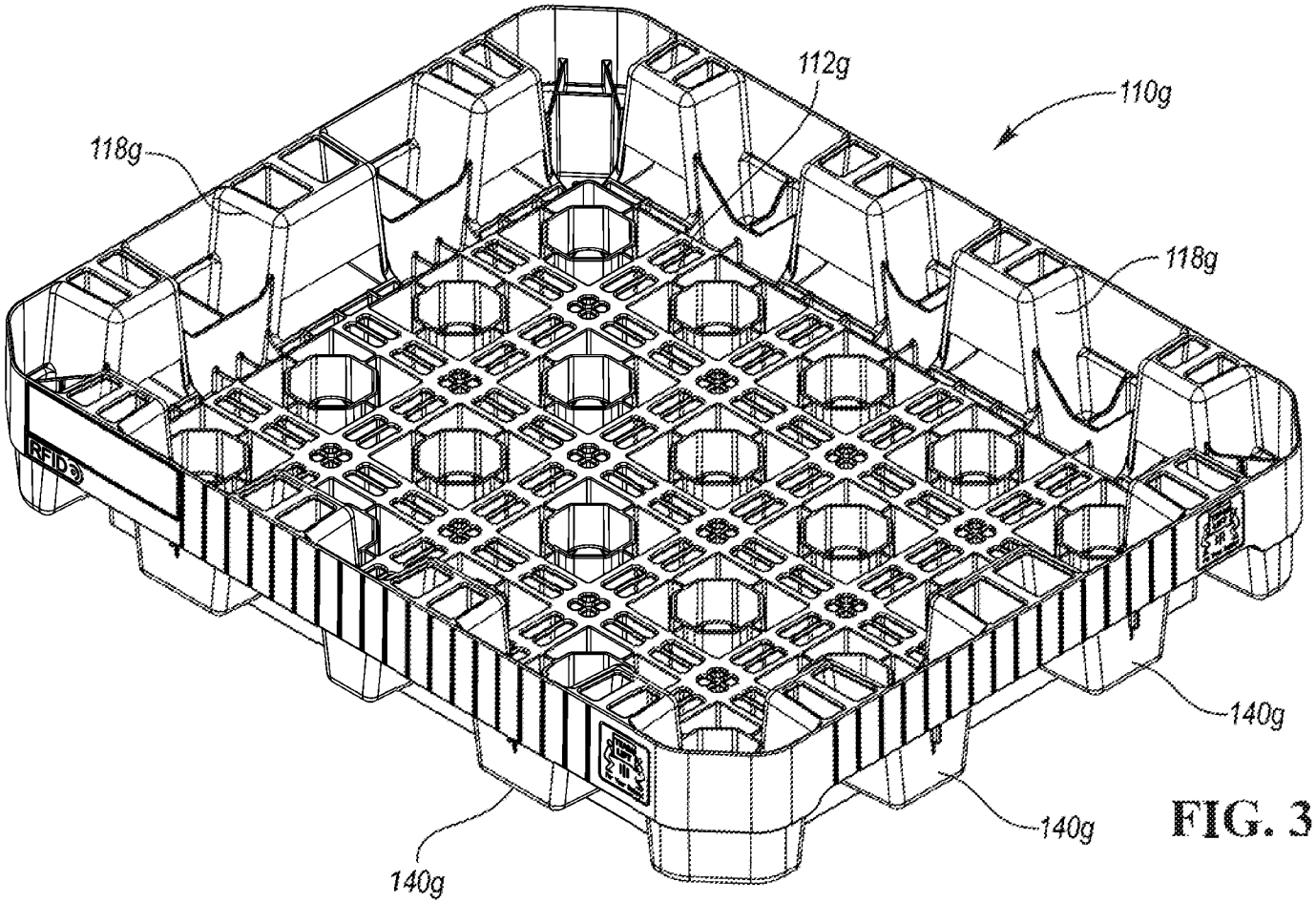
FIG. 32 is a perspective of an alternate second tray.
Figure 33:
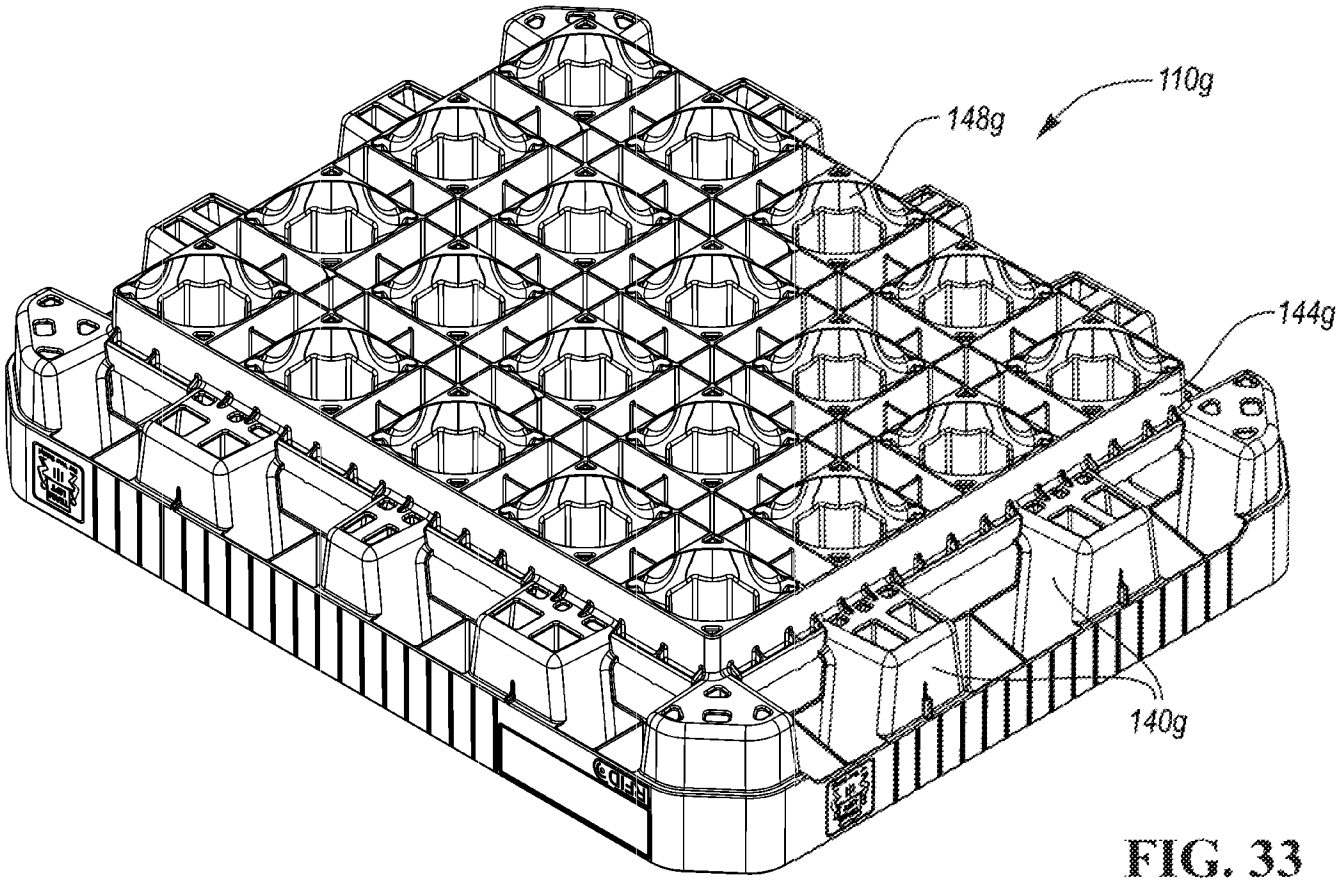
FIG. 33 is a bottom perspective view of the tray of FIG. 32.

FIG. 32 is a perspective of an alternate second tray 110*g* configured to work with the alternate first tray 10*g* in the same manner as the trays 10, 110 of FIG. 1. The columns 118*g* project further into the tray 110*g* than those of the first tray 10*g* to accommodate the smaller containers 190 (FIG. 1). The tray 110*g* is configured to have a 4×5 container support areas. The lower column portions 140*g* also project inward of the second tray 110*g* further than those of the first tray 10*g*, as is further shown in FIG. 33. As shown in FIG. 33, the lower peripheral rib 144*g* projects downward just inward of the lower column portions 140*g* (with just a small ledge in between). The central portion further includes concave, angled and/or contoured, somewhat conical surfaces 148g that are complementary to the upper surfaces of the small containers 190 (FIG. 1).

Figure 34:
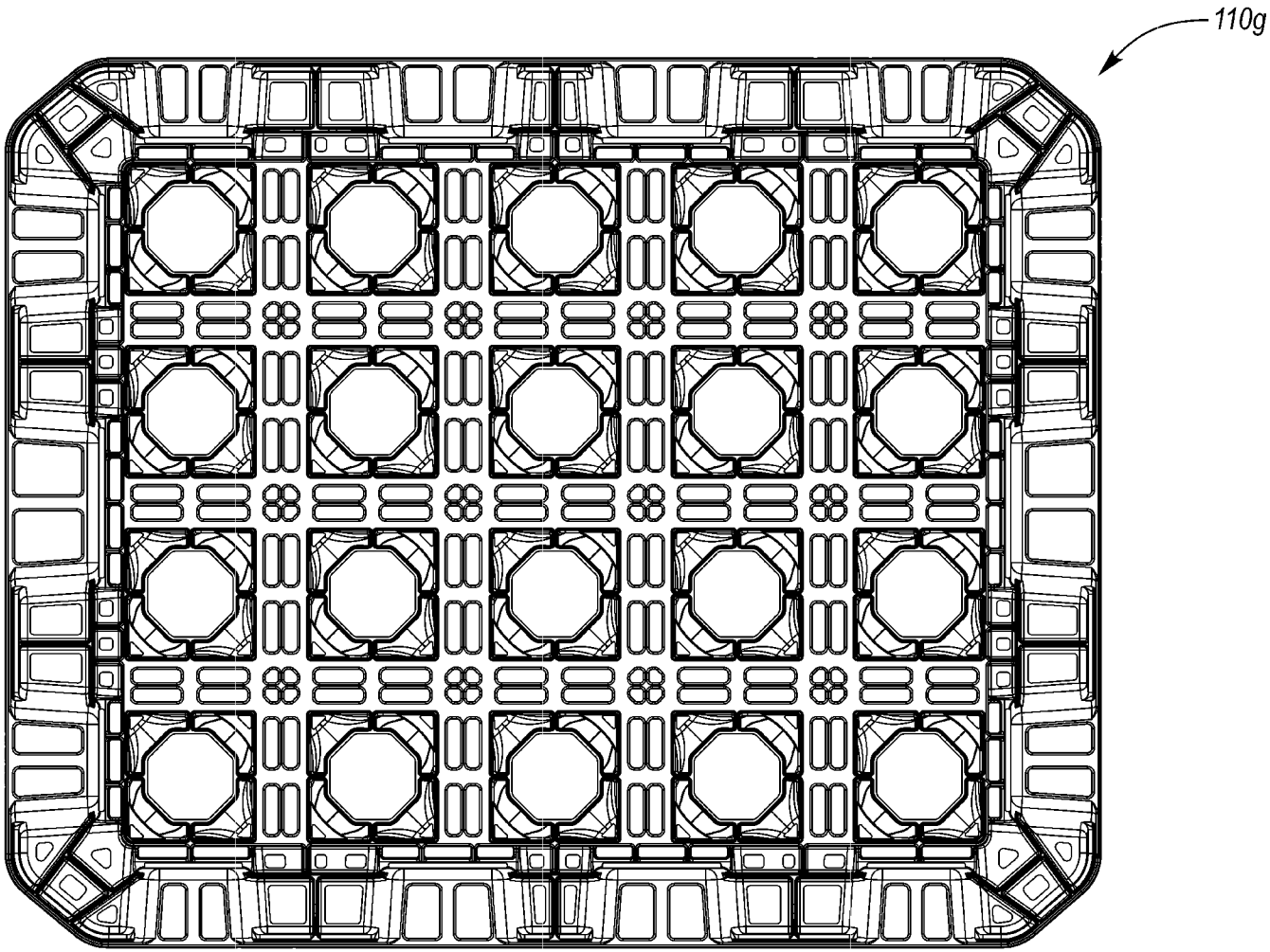
FIG. 34 is a top view of the tray of FIG. 32.
Figure 35:
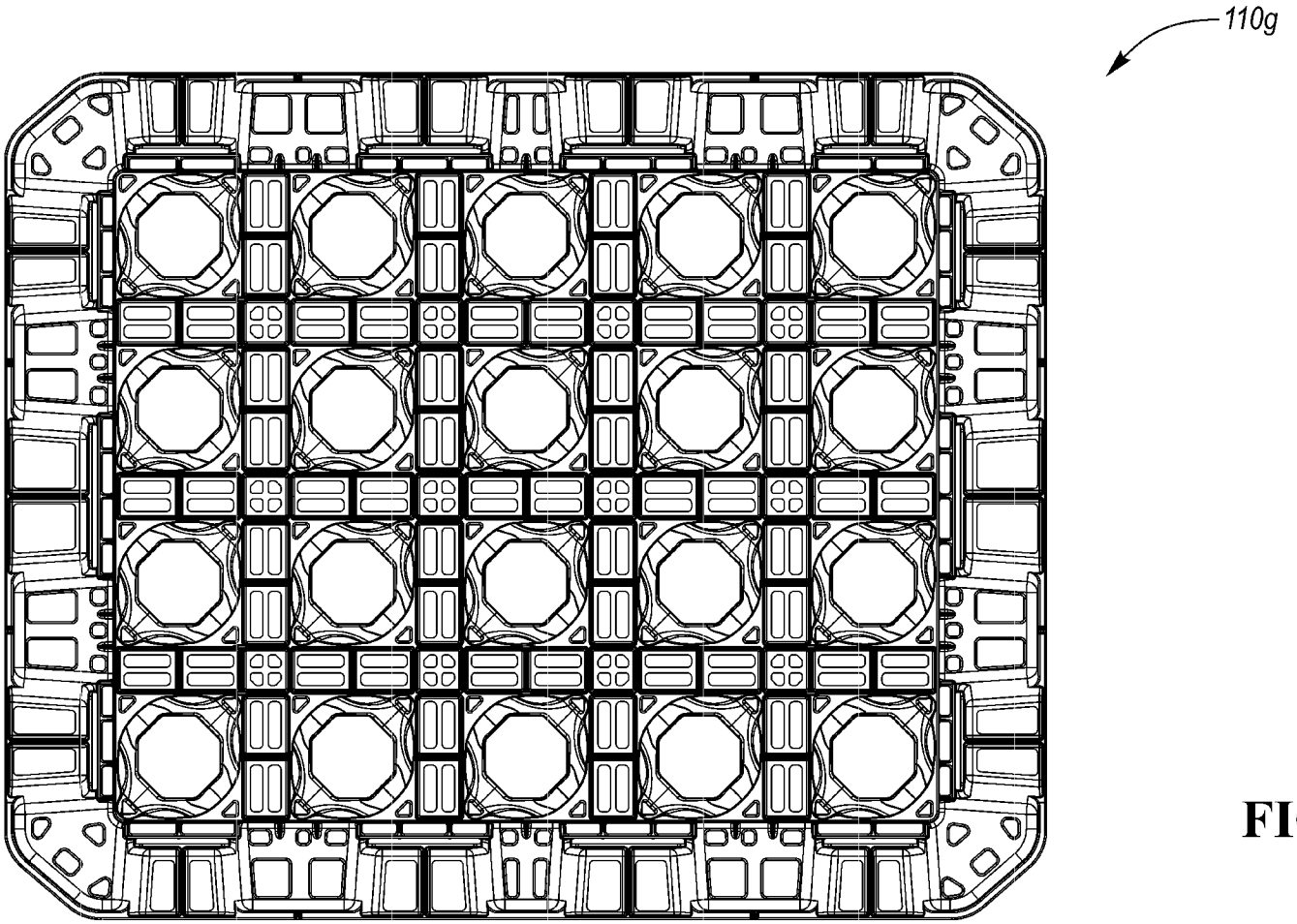
FIG. 35 is a bottom view of the tray of FIG. 32.
Figure 36:
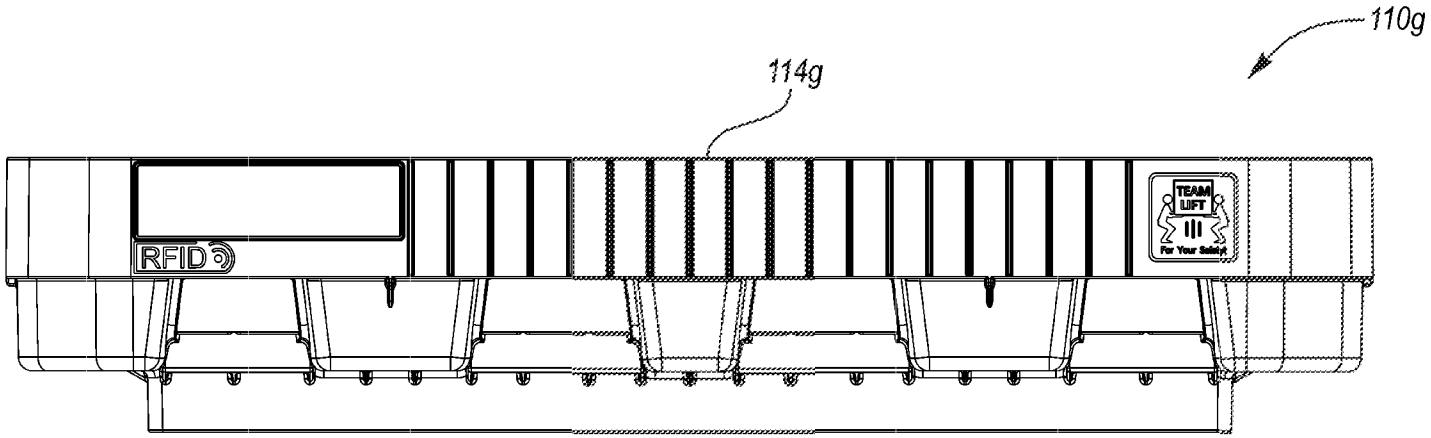
FIG. 36 is a side view of the tray of FIG. 32.
Figure 37:
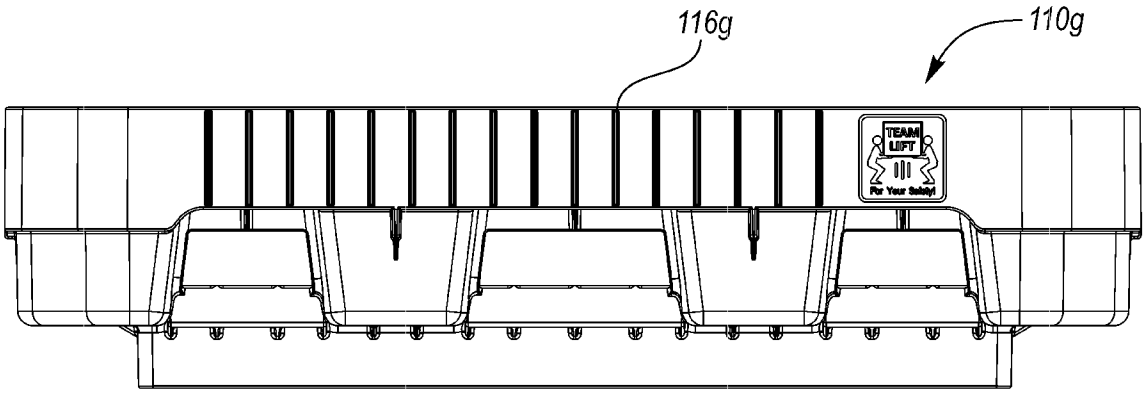
FIG. 37 is an end view of the tray of FIG. 32.

FIG. 34 is a top view of the second tray 110g. FIG. 35 is a bottom view of the second tray 110g. FIG. 36 is a side view of the second tray 110g. FIG. 37 is an end view of the second tray 110g.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray comprising:

a base having an upper support surface, the base including a central portion extending downward from the upper support surface to define a lowermost surface of the tray, the base including a peripheral portion extending downward from the upper support surface less than the central portion, the peripheral portion extending continuously around the central portion of the base;

a pair of opposed first walls extending along opposed first edges of the base; and a pair of opposed second walls extending along opposed second edges of the base, the upper support surface defined from one of the opposed first walls to the other of the opposed first walls and from one of the opposed second walls to the other of the opposed second walls.

2. The tray of claim 1 wherein the peripheral portion extends below the upper support surface of the base.

3. The tray of claim 2 wherein the base includes a plurality of vertical first ribs defining the peripheral portion and a plurality of vertical second ribs defining the central portion, and wherein the second ribs are longer than the first ribs such that a lower surface of the peripheral portion is recessed relative to a lowermost surface of the central portion.

4. The tray of claim 3 wherein the central portion includes a plurality of concave recesses on a lower surface thereof, the plurality of recesses each configured to receive an upper portion of a container sized to be shipped in the tray.

5. The tray of claim 1 further including a plurality of upper column portions projecting inward from an inner periphery of the first walls.

6. The tray of claim 5 further including a plurality of lower column portions between and below the plurality of upper column portions.

7. The tray of claim 6 wherein the plurality of lower column portions are spaced apart from one another and project outward from the peripheral portion of the base.

8. The tray of claim 7 wherein lowermost surfaces of the lower column portions are substantially flush with the peripheral portion of the base.

9. The tray of claim 8 wherein the upper column portions are tapered upward and the lower column portions are tapered downward, such that the upper column portions of the tray would be received between the lower column portions of an identical tray nested thereon.

10. The tray of claim 9 wherein the peripheral portion is at least 1.5 inches wide.

11. The tray of claim 10 wherein the tray is molded as a single piece of plastic.

12. The tray of claim 1 wherein the peripheral portion is at least 1.5 inches wide.

13. The tray of claim 1 wherein the peripheral portion is directly below the upper support surface of the base.

14. The tray of claim 13 wherein the peripheral portion is at least 1.5 inches wide.

15. The tray of claim 1 wherein the peripheral portion is between the pair of opposed first walls and between the pair of opposed second walls.

16. A tray system comprising:

a first tray having a base, the base having an upper support surface and a central portion extending downward from the upper support surface to define a lowermost surface of the first tray, an underside of the base including a peripheral portion recessed upward relative to the central portion, wherein the peripheral portion is directly below the upper support surface of the base, a lower surface of the central portion of the first tray including a plurality of first concave recesses arranged in 4×3 array, the first concave recesses configured to receive upper ends of first containers, the first tray including a plurality of walls extending proximate the periphery of the base, the plurality of walls defining an outer footprint of the first tray; and a second tray having a base, the base having an upper support surface and a central portion extending downward from the upper surface to define a lowermost surface of the second tray, an underside of the base including a peripheral portion recessed upward relative to the central portion, a lower surface of the central portion of the second tray including a plurality of second concave recesses arranged in 4×5 array, the second concave recesses configured to receive upper ends of second containers, the second tray including a plurality of walls extending proximate the periphery of the base, the plurality of walls of the second tray defining an outer footprint of the second tray, wherein the outer footprint of the first tray is substantially the same as the outer footprint of the second tray.

17. The tray system of claim 16 wherein the first tray is partially nestable in the second tray.

18. The tray system of claim 17 wherein the second tray is nestable in the first tray.

19. The tray system of claim 18 wherein the first tray includes a plurality of first upper column portions projecting inward a first distance from an inner periphery of the plurality of walls of the first tray, wherein the second tray includes a plurality of second upper column portions projecting inward a second distance from an inner periphery of the plurality of walls of the second tray, wherein the second distance is greater than the first distance.

20. The tray system of claim 16 wherein the first containers are sized to be shipped in the first tray and are received in the first tray, and wherein the second containers are sized to be shipped in the second tray and are received in the second tray.

21. The tray system of claim 20 wherein the peripheral portions of the first tray and the second tray are at least 1.5 inches wide.

22. The tray of claim 16 wherein the peripheral portion is at least 1.5 inches wide.

23. The tray system of claim 16 wherein the concave recesses of the first tray each circumscribe an opening into the central portion of the first tray.

24. A tray comprising:

a base having an upper support surface, the base including a central portion extending downward from the upper support surface to define a lowermost surface of the tray, the base including a peripheral portion extending downward from the upper support surface less than the central portion, wherein the peripheral portion includes a plurality of interconnecting transverse ribs extending continuously around the central portion, wherein the central portion includes a plurality of concave recesses on a lower surface thereof, the plurality of recesses each configured to receive an upper portion of a container sized to be shipped in the tray;

a pair of opposed first walls extending along opposed first edges of the base;

a pair of opposed second walls extending along opposed second edges of the base, the upper support surface defined from one of the opposed first walls to the other of the opposed first walls and from one of the opposed second walls to the other of the opposed second walls;

a plurality of upper column portions projecting inward from an inner periphery of the pair of opposed first walls, wherein the upper column portions are coplanar with an uppermost edge of the pair of opposed first walls; and a plurality of lower column portions between and below the plurality of upper column portions, wherein the plurality of lower column portions project outward from the peripheral portion of the base, wherein lowermost surfaces of the lower column portions are substantially flush with the peripheral portion of the base, wherein the tray is molded as a single piece of plastic.

25. The tray of claim 24 wherein the peripheral portion is at least 1.5 inches wide.

* * * * *